US008333133B2

(12) United States Patent
Brovold

(10) Patent No.: US 8,333,133 B2
(45) Date of Patent: Dec. 18, 2012

(54) SYSTEM TO ENABLE HIGH SPEED OPERATION OF SOCKET TYPE RATCHET WRENCHES AND OTHER TOOLS

(75) Inventor: Thomas Emil Brovold, Barns, WI (US)

(73) Assignee: Spinzit Tools LLC, Barnes, WI (US)

( * ) Notice: Subject to any disclaimer, the term of this patent is extended or adjusted under 35 U.S.C. 154(b) by 195 days.

(21) Appl. No.: 12/978,054

(22) Filed: Dec. 23, 2010

(65) Prior Publication Data

US 2011/0088518 A1 Apr. 21, 2011

Related U.S. Application Data

(63) Continuation-in-part of application No. 12/545,150, filed on Aug. 21, 2009, now Pat. No. 8,196,494.

(60) Provisional application No. 61/176,568, filed on May 8, 2009.

(51) Int. Cl.
*B25B 13/00* (2006.01)

(52) U.S. Cl. ..... 81/58.1; 81/57.3; 81/58

(58) Field of Classification Search ..... 81/57.3, 81/58, 58.1

See application file for complete search history.

(56) References Cited

U.S. PATENT DOCUMENTS 4,184,390 A * 1/1980 Evans ..... 81/57.3
6,193,624 B1 * 2/2001 Lund ..... 474/203
7,320,267 B1 * 1/2008 Chen ..... 81/58.1

* cited by examiner

*Primary Examiner* — Lee D Wilson
*Assistant Examiner* — Shantese McDonald
(74) *Attorney, Agent, or Firm* — Larkin Hoffman Daly & Lindgren Ltd.; Craig J. Lervick

(57) ABSTRACT

A drive system cooperates with other tools, such as the drive mechanism of a socket type ratchet wrench to enable a user to use the wrench for its intended purpose at high speed by pulling an endless belt. The belt is contained within a chamber created by the attachment system in a manner to allow the belt to engage with an outer surface of a pulley. The pulley connected to the drive shaft of the socket type ratchet wrench to cause force to be transferred from the belt to the wrench drive shaft. The system utilized a cover operably coupled to the pulley to contain the belt while minimizing interference with the wrench. The cover contains the belt while also allowing an opposite end of the belt to hang loose and thus be easily accessible by a user.

24 Claims, 27 Drawing Sheets

SYSTEM TO ENABLE HIGH SPEED OPERATION OF SOCKET TYPE RATCHET WRENCHES AND OTHER TOOLS

RELATED APPLICATIONS

This application is a continuation-in-part of U.S. application Ser. No. 12/545,150 filed Aug. 21, 2009 entitled "Attachment System for Ratchet Type Wrenches", which claims the benefit of previously filed U.S. Provisional application 61/176,568, filed May 8, 2009 and entitled "Attachment System for Ratchet Type Wrenches".

BACKGROUND

The invention generally relates to mechanisms that remove and install nuts, bolts and other fasteners. More specifically, the embodiments described below provide tools and methods for the high speed installation or removal of fasteners.

Ratchet mechanisms are typically used to cause the small forceful angular rotation of a fastener, and then rotate the handle in reverse without rotating the fastener. By allowing for this repeated rotational motion, a user can easily remove a fastener without taking the wrench on and off. This ratcheting function is typically achieved by appropriately engaging and disengaging a ratcheting mechanism (such as a gear with teeth and a pawl interacting with the gear teeth in a desired manner). In several applications the available amount of rotation is very small due to physical constraints (e.g. working in tight spaces). This demands numerous back and forth angular rotations enabled by the ratchet mechanisms. In some cases, a full revolution may take up to 72 back and forth ratchet motions. More typically, an application may allow about 4-5 back and forth rotations per revolution. Given that a fastener typically requires several threads to be engaged and often includes additional threads for starting the fastener, removal with a standard socket wrench can often require many back and forth motions. This can result in approximately a minute to remove or install a single fastener. This slow speed can be an annoying and troublesome characteristic of ratchet wrenches, especially for mechanics or other individuals who deal with these type of fasteners many times throughout their day.

Often, when using a ratchet mechanism the fastener is very loose for most of the removal or installation operation. In these circumstances, the user must grasp the drive head to prevent it from turning backwards without ratcheting over the gear. This is an additional annoying characteristic of ratchet mechanisms.

There have been numerous previously developed devices for turning of a fastener using alternative motions. For example, certain devices incorporate the cranking or twisting motion of a handle portion, which is then translated into dive head rotation of a socket wrench. Similar approaches or methods do not presently exist for the box end ratchet wrenches or typical socket wrenches. Generally, prior approaches to this problem of fast spinning fasteners have all included rather complex and expensive mechanisms to create the necessary motion. As such, there is a need for a simple mechanism that allows for the faster spinning of fasteners which utilizes the existing structures of box end wrenches or socket wrenches.

SUMMARY

One simple but elegant solution which addresses the above discussed problem uses a flexible belt appropriately attached to either a portion of a wrench or a related wrench attachment.

The sizing and configuration of the belt provides for engagement on only one end of the wrench while allowing the remainder of the belt to hang loose. This is contrary to the typical approach which includes the need to stretch the belt over two wheels in order to maintain tooth engagement. By wrapping the belt over only one end of the wrench however, makes it necessary to include other components which hold the belt in contact with the gear teeth on that end of the wrench. Several methods may be utilized to do this, but may require modification of the tool.

A common box-end ratchet wrench typically has an exposed gear on each end. These gears allow the wrench to be easily converted to a very high speed tool that eliminates the need for continuous back and forth motion often necessary to remove or install a fastener. By holding a belt over one of the gears, fast rotation can be accomplished very easily by pulling on a loose "half" of the continuous belt. In this manner, a user can achieve multiple rotations of the fastener in a very short period of time.

Keeping the teeth of the exposed gear engaged with the belt, without having the belt fall off or loosen, is a challenge. This is generally solved by placing an elastic or similar holding band over the belt and the end of the tool, thereby containing the belt. Keeping the belt engaged can be a challenge however, due to the rapid movement of the belt. Specifically, the lateral forces caused by pulling on the belt can tend to dislodge the elastic band. To alleviate this problem, a raised surface or other type of interfering structure is created on the ratchet wrench to stop the elastic band from moving away from its neutral position around the ratchet. One approach to creating this raised surface is the inclusion of an elastic band, or rubber band around the neck of the wrench. This addition enables the conversion of a typical box-end ratchet wrench into a high speed tool that will be usable in very tight quarters.

The "belt concept" generally described above can be applied to many different wrenches. As suggested, the box-end ratchet wrench has exposed gear teeth on the end which makes this an attractive candidate. In the case of a dual sided or two end wrench, gear teeth will be exposed on each end. Wrapping a belt over one set of these gear teeth, causing engagement between the teeth and the belt, creates a valuable high speed tool. To use the opposite end, the belt is simply repositioned over the gear teeth at the other end.

The same "belt" concept discussed above can be utilized with many different wrenches or alternative tools. In some cases, modifications or adaptations are necessary. In further cases, additional adapters for components are necessary. For example, by adding a gear wheel attachment to the drive of a standard socket wrench will result in the easy conversion to a high speed tool. The gear wheel attachment can be configured to take up little working space, and continue to accommodate the attachment of sockets to the socket wrench drive in a traditional manner. As another alternative a standard socket wrench can be designed to have exposed gears on a top end, very similar to the box end ratchet wrenches discussed above. With this modification, the socket wrench can be easily adapted for a high speed operation in a manner very similar to that disclosed with relation to the box end ratchets mentioned above.

BRIEF DESCRIPTION OF THE DRAWINGS

Further objects and advantages of the present invention can be seen by reading the following detailed description in conjunction with the drawings in which.

DETAILED DESCRIPTION OF THE VARIOUS EMBODIMENTS

Generally speaking, one aspect of the present invention involves the use of a belt specifically designed to engage with a drive mechanism to convert a standard ratchet wrench into a high speed tool. This aspect typically requires the belt to have some engaging structure thereon, which mates or meshes with a similar engaging structure in the wrench. As will be further discussed below however, the engagement does not necessarily require the close meshing of components (i.e. the teeth of the belt and the teeth of the drive structure do not have to match). In addition to the belt, some holding structure is necessary to maintain a level of engagement at the drive end, while also allowing the free end of the belt to be accessible by the user. By combining these various aspects of the invention an efficient and effective tool is created which provides for high speed operation not available with other devices.

Figure 1:
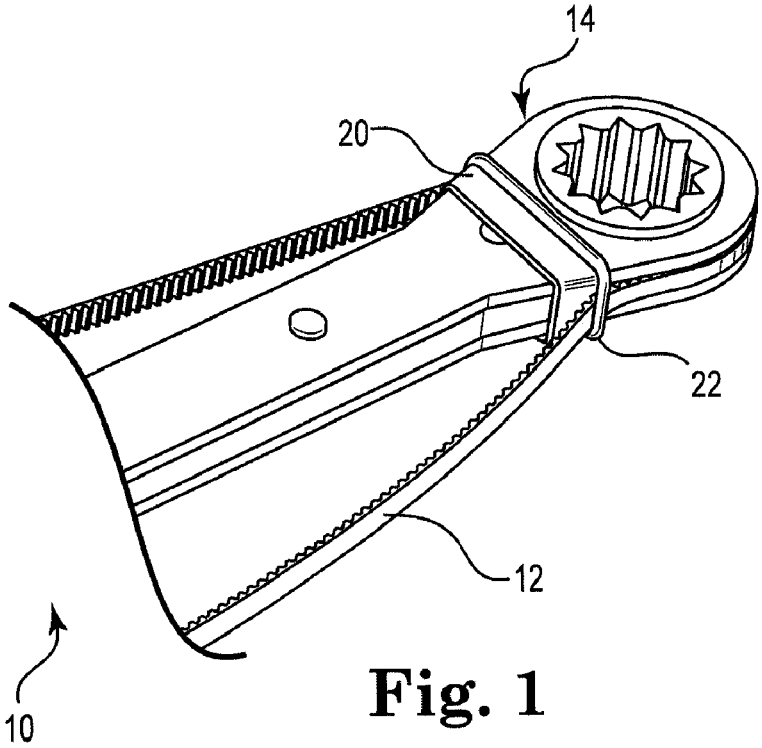
FIG. 1 provides a perspective view of the attachment system utilized on a box end ratchet wrenches.

As suggested above, it is necessary to contain or hold the belt in place to maintain engagement with the wrench gear teeth. As illustrated in FIG. 1, one embodiment of the invention utilizes a first holding band 20 placed in close contact with a body portion 14 of a wrench 10. First holding band 20 is preferably made of rubber or some similar substance, thereby creating a considerable amount of friction with body portion 14. Also attached to wrench 10 is a second holding band 22, which is specifically selected to have a low friction surface structure. As illustrated, belt 12 will be positioned on top of first holding band 20, while being positioned below second holding band 22. This combination of first holding band 20 and second holding band 22 allows belt 12 to be pulled and consequently slide without being pulled off wrench 10.

The appropriate sizing and configuration of the two holding bands (20 and 22) create a unique holding mechanism. Due to the materials making up first holding band 20, it will generally stay positioned on wrench body 14. As shown, this positioning will not interfere with general operation of wrench 10. In addition, the make-up of second holding band 22 will contain belt 12 while also allowing movement. In one embodiment, second holding band 22 will have a fabric outer layer, thereby establishing the desired low amount of friction. Second holding band 22 is positioned "above" first holding band 20 however, thus preventing it from sliding "down" the body of the wrench. Thus, the cooperation of the two holding bands efficiently holds belt in engagement with the gear teeth of wrench 10.

Figure 2:
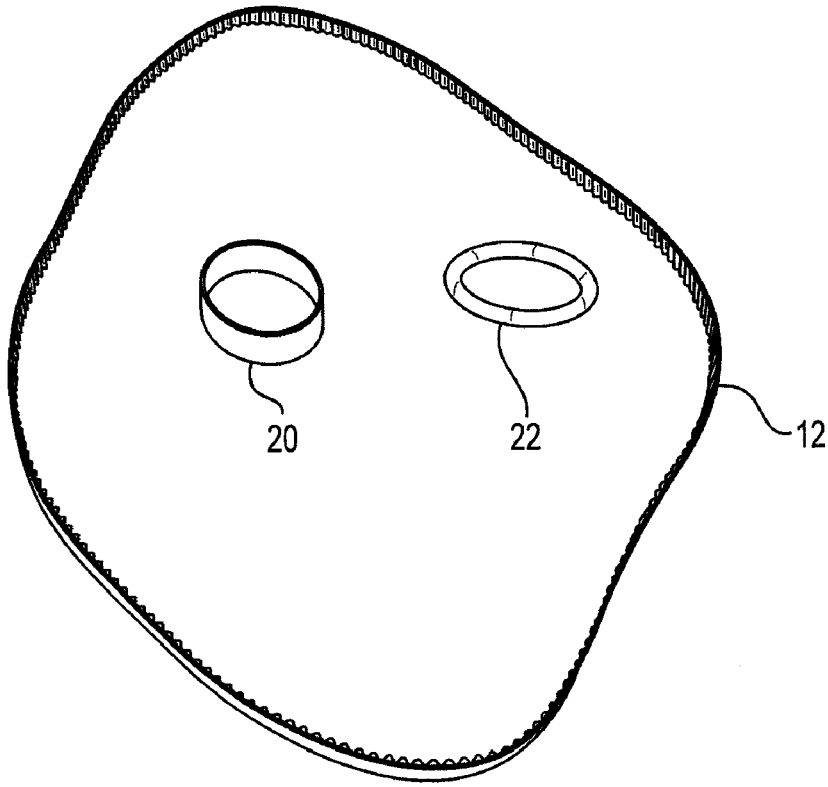
FIG. 2 illustrates the primary components making up the attachment system.

The general configuration of belt 12, first holding band 20 and second holding band 22 are shown in FIG. 2. Generally speaking, belt 12 is configured for appropriately engaging with gear teeth on a desired wrench. In this case, close engagement (e.g. having teeth on both belt 12 and gear specifically designed to closely fit with one another) is not necessary or contemplated in all circumstances. Rather, a general interfering structure is contemplated which creates a level of friction capable of driving the wrench. Further, first holding band 20 is intended to be securely attached to the body of a wrench. Lastly, second holding band 22 is intended to hold belt 12 in a desired "engagement" position, while also allowing appropriate sliding.

As mentioned above, first holding band 20 may be an elastic band of some type. In certain situations other materials may be desired to manage wear that may result from belt 12 sliding along the surface of first holding band 20. This may be further exaggerated by the teeth of belt 12 degrading the surface. As such, a more wear resistant material may be desired in these circumstances. That said, the wear on first holding belt 20 must be balanced with the ease of attachment and its ability to hold position. As such, different materials may be appropriate for different applications.

Figure 3:
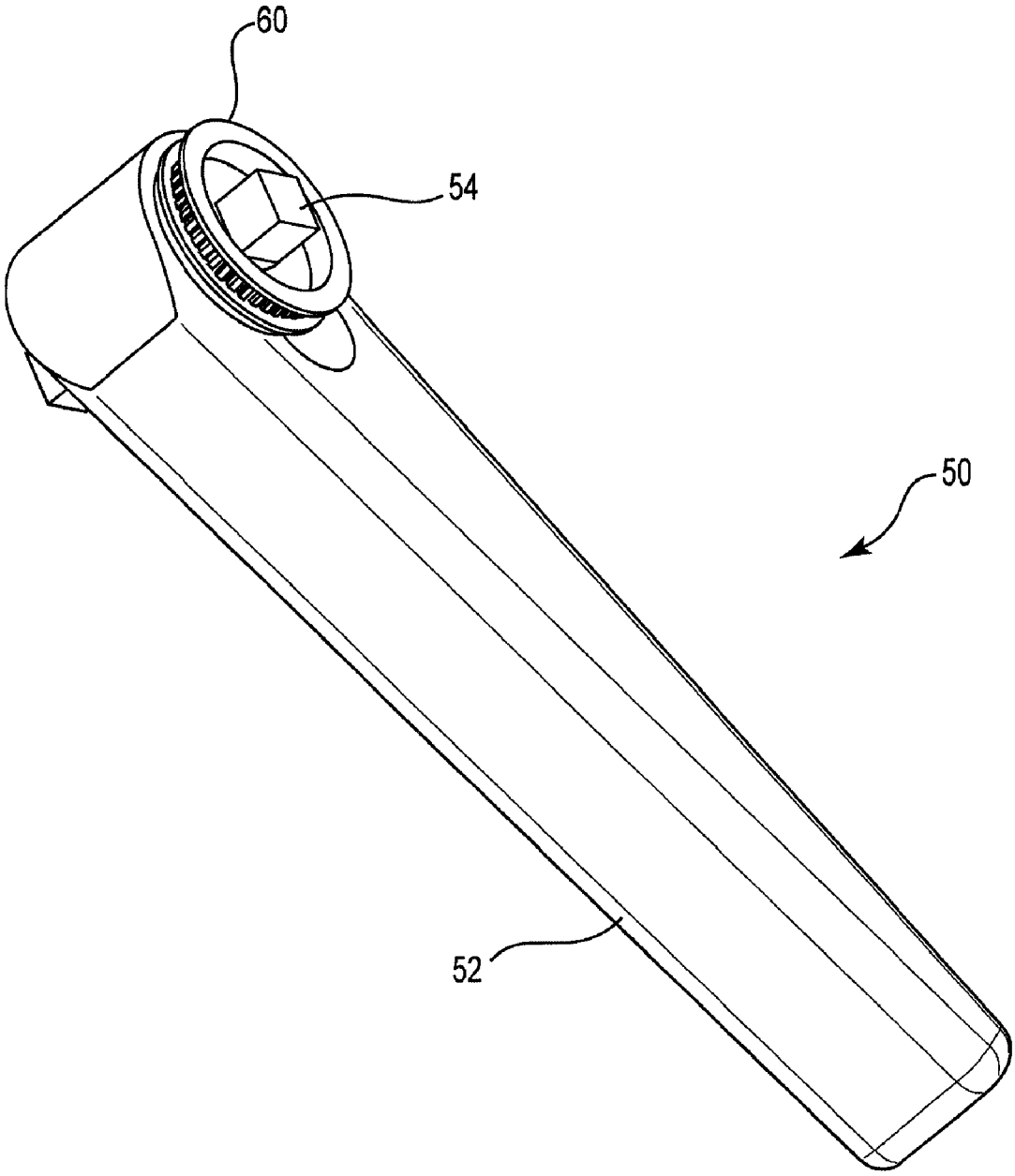
FIG. 3 illustrates one embodiment of a ratchet wrench having a gear wheel attachment.

FIG. 3 illustrates another method of implementing the belt feature on various wrenches. Thousands of socket wrenches are used every day around the world. These socket wrenches exist in many different formats, but all generally have a drive shaft of some type. Most commonly, the drive shaft has a square cross section, and is specifically designed for attachment to various sockets. FIG. 3 illustrates one such socket wrench. Generally speaking, wrench 50 has a handle portion 52 and a drive shaft 54 extending from one end. A ratcheting mechanism (not shown) is contained within wrench 50 to achieve the ratcheting function. FIG. 3 also illustrates a pulley 60, attached to drive shaft 54. As better illustrated in FIG. 4, pulley 60 is generally disc shaped and includes a square aperture 62 in a central portion thereof. A groove 64 exists on an outer circumferential edge 66. The bottom portion of groove 64 includes teeth or gear-like structures 68 which are designed to interact with a belt. Lastly, pulley 60 further includes a central recess 70 in one side. As discussed below, central recess accommodates attachment of sockets when wrench 50 is used.

Figure 5:
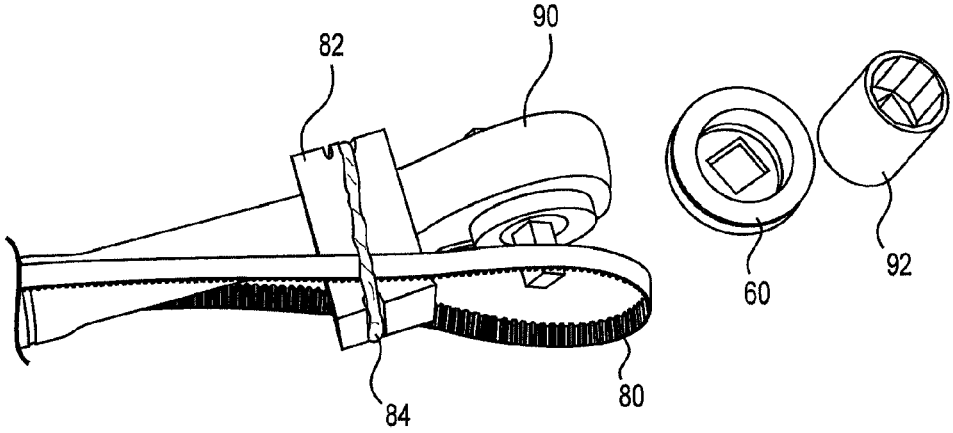
FIGS. 5 & 6 forms an exploded view of the component parts utilizing a gear wheel attachment and a standard socket wrench.
Figure 6:
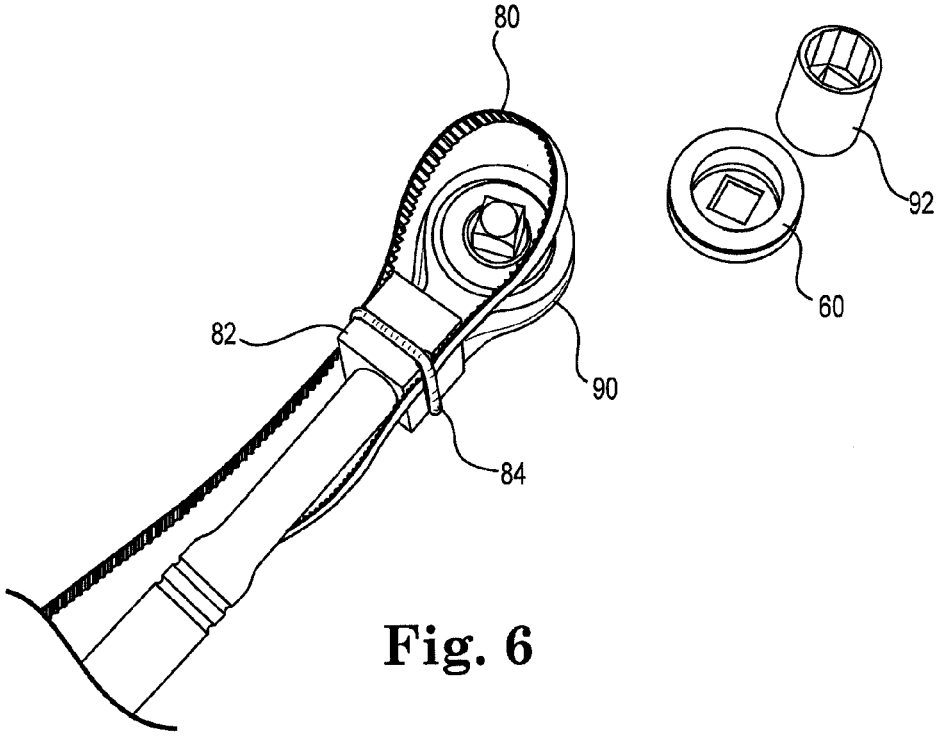
Figure 7:
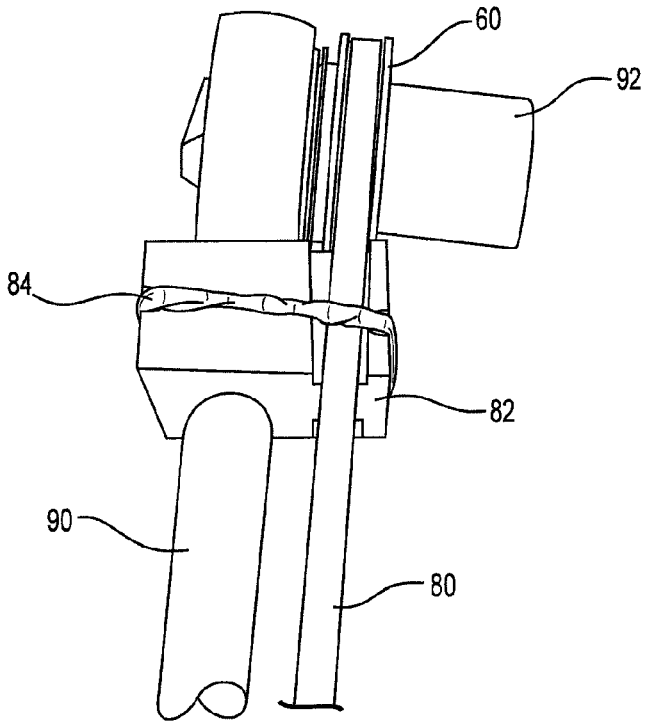
FIGS. 7 & 8 illustrate another embodiment of the gear wheel attachment concept.
Figure 8:
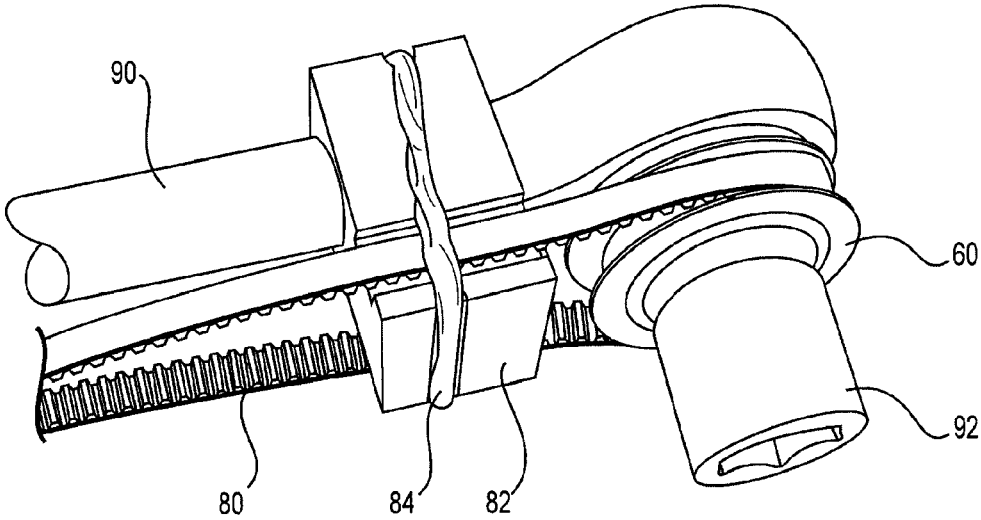

FIGS. 5-8 illustrate the use of pulley 60 in conjunction with a wrench 90. FIGS. 5-6 illustrate an unassembled high speed wrench system, having a well understood ratchet wrench 90, a socket 92, pulley 60, a belt 80, a first holding band 82 and a second holding band 84. These same components are illustrated as assembled in FIGS. 7-8. Again, the attachment of belt 80 allows for the high speed spinning of socket 92. In this embodiment, pulley 60 makes this function possible by incorporating a gear-like structure for interaction with belt 80. Although configured in a slightly different manner, first holding band 82 and second holding band 84 cooperate to contain belt 80 in the manner described above in relation to FIG. 1.

Figure 4:
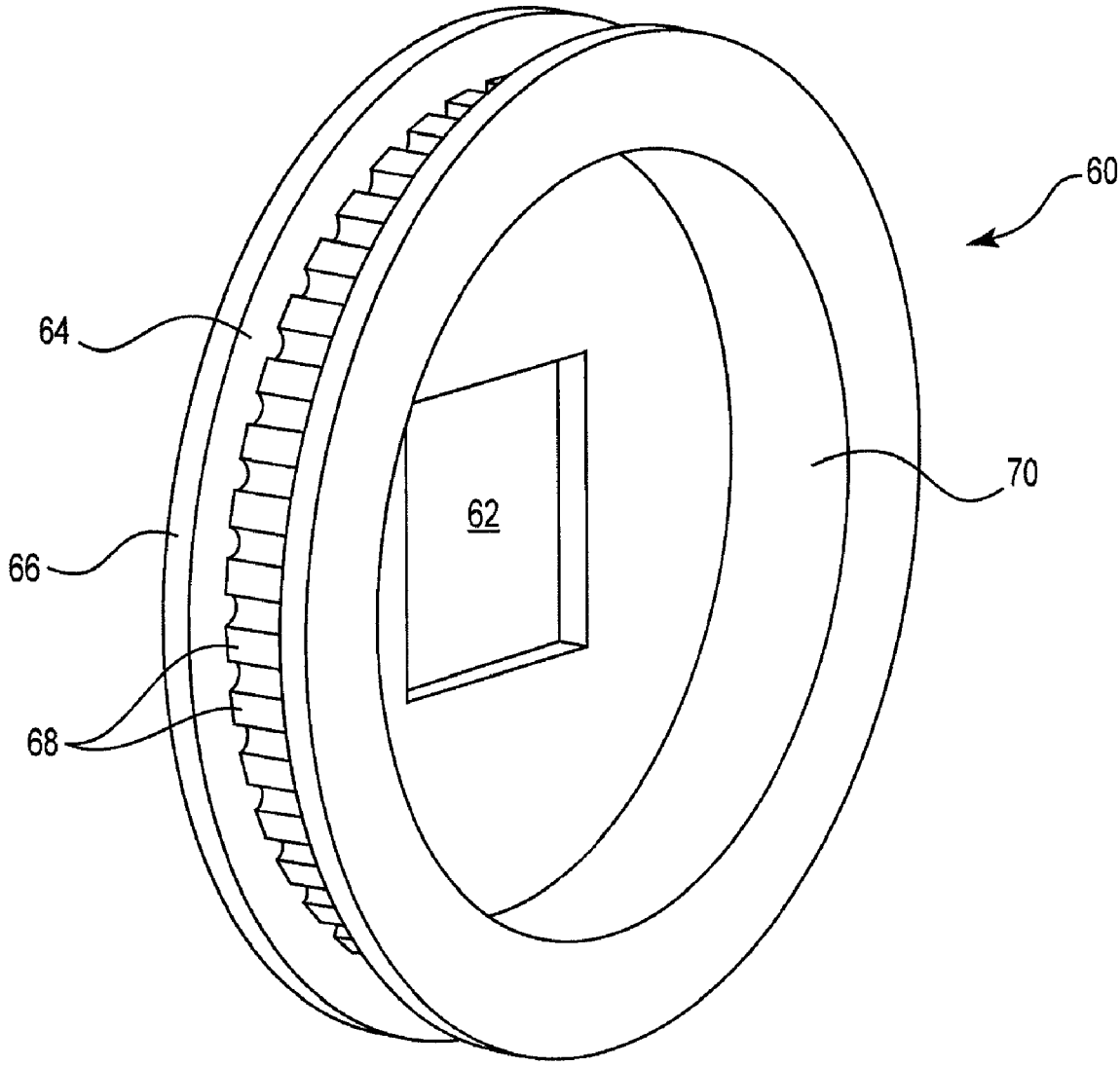
FIG. 4 shows a perspective view of the gear wheel attachment useable with standard socket wrenches.

Although FIG. 4 illustrates a separate detachable pulley, this structure could be incorporated into the wrench mechanism. For example, this could be created in a manner similar to the well understood thumb wheel, which is well accepted and used by those skilled in the art.

Figure 9:
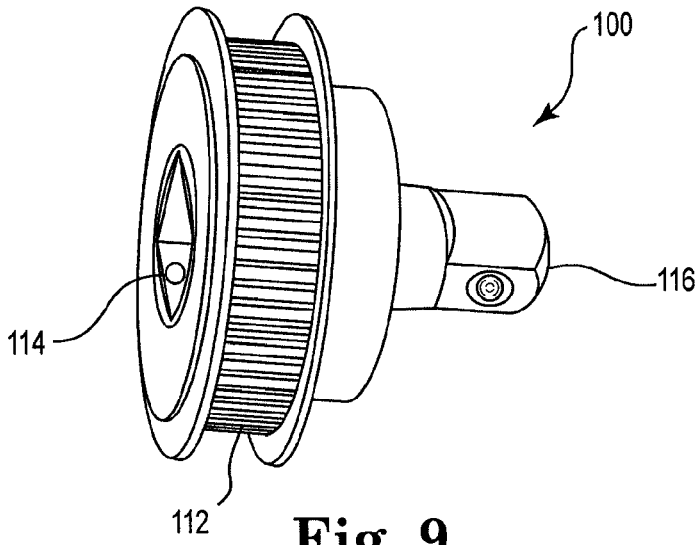
FIG. 9 shows a second embodiment of the gear wheel attachment concept.
Figure 10:
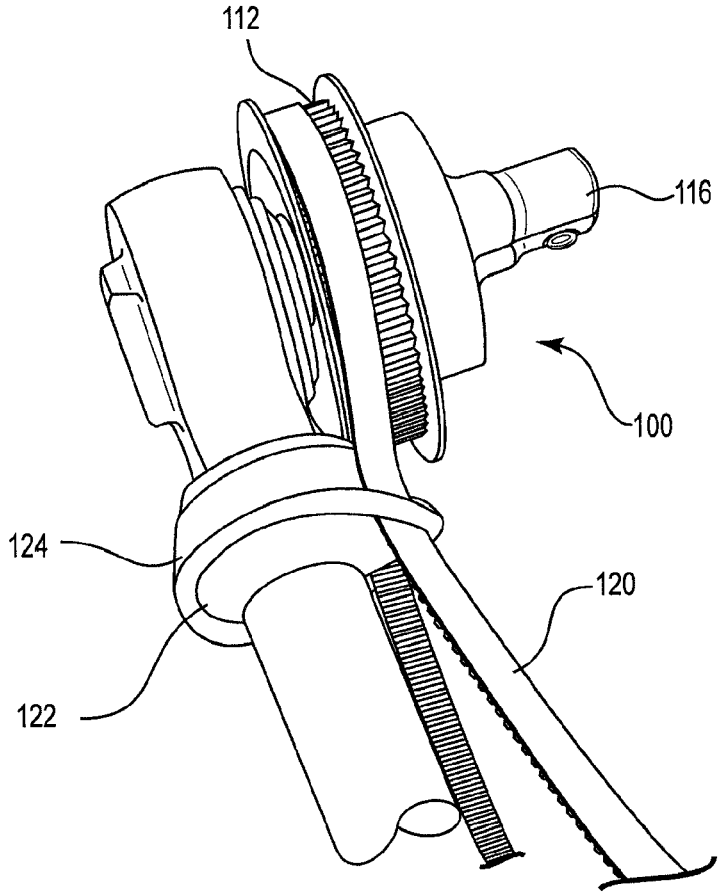
FIG. 10 illustrates the second embodiment as incorporated with a standard socket wrench.

Yet another implementation of the high speed drive is illustrated in FIGS. 9 & 10. FIG. 9 specifically illustrates an extension attachment 100 for use in conjunction with a standard socket wrench. Extension attachment 100 includes a disc shaped portion 110 with a recess 112 existing on a circumferential edge. Recess 112 is again configured to interact with a belt (not shown). One side of extension 100 includes a receptacle 114 designed to receive the drive shaft of a typical socket wrench. An opposite side of extension attachment 100 includes and extension drive shaft 116 configured for attachment to standard sockets.

Attachment extension 100 is illustrated in FIG. 10 as being attached to a standard socket wrench. As shown, a wrench 118 has extension attachment 100 connected thereto. Yet another belt 120 is attached to wrench 118 and extension attachment 100. Belt 120 is again contained by a first holding band 122 and a second holding band 124. These holding bands (122 & 124) also cooperate to contain belt 120 as discussed above.

Figure 11:
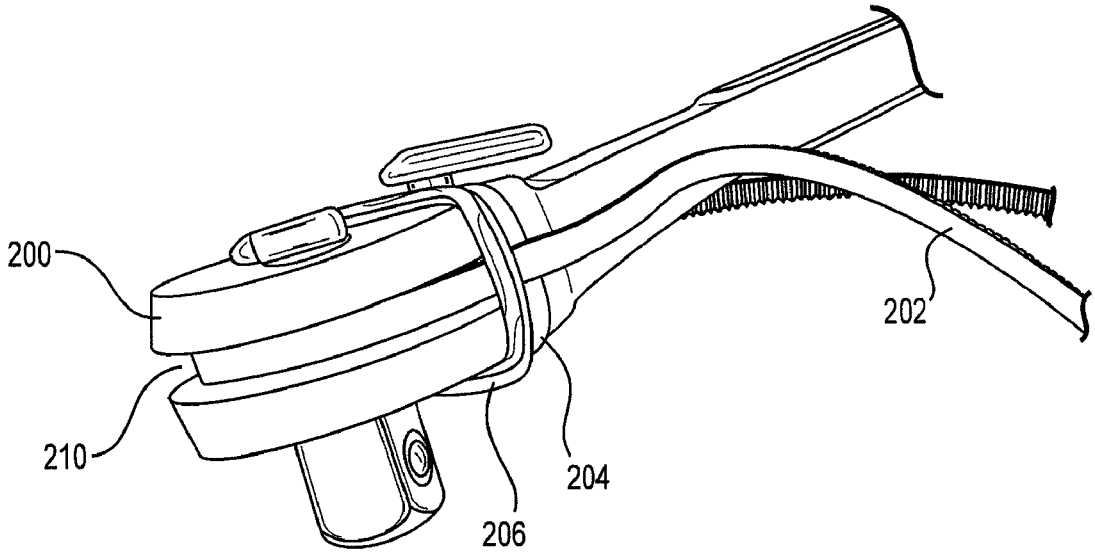
FIG. 11 illustrates yet another embodiment of the high speed attachment system utilized with a specially configured socket wrench.

A further implementation of the belt drive concept is illustrated in FIG. 11. In this case, a wrench 200 again has a belt 202 attached thereto, and contained by a first holding band 204 and a second holding band 206. In this implementation however, the body of wrench 200 includes specific accommodations which allow belt 202 to interact with gear teeth (not shown) contained within. More specifically, a groove 210 has been created at a top end of wrench 200, which exposes underlying gear teeth associated with the internal ratchet mechanism. Again, the holding bands will operate in a manner similar to those described above to contain belt 202 while also allowing movement.

Figure 12:
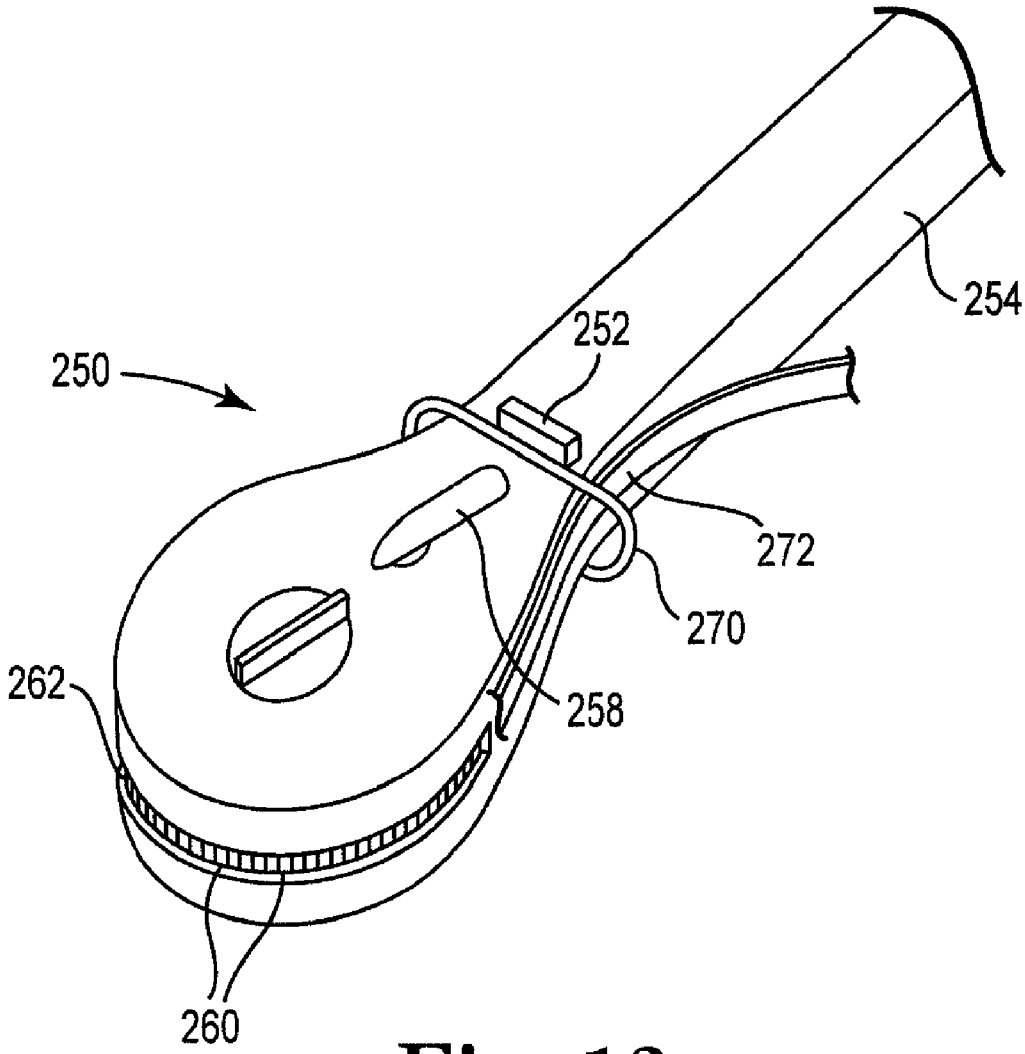
FIG. 12 provides a perspective view of an alternative embodiment also using a specifically configured socket wrench.

FIG. 12 shows yet another embodiment utilizing the principles of the present invention. This embodiment has a fairly standard socket wrench, which has been modified to include a slight ridge 252 which is used as a holding structure. More specifically, a wrench 250 contains the standard components such as a handle 254, a drive shaft 256, and a direction switch 258. Again, wrench 250 includes exposed gear teeth 260, which are accessible via a groove or slot 262 at the upper end of the wrench. In this embodiment, only a single holding band 270 is used to contain belt 272 (with only a portion of the belt being illustrated in this figure). Holding band 270 is again preferably configured to have a low friction surface thus allowing belt to easily slide. The presence of ridge 252 will keep holding band 270 will keep in position thus also keeping belt 272 in the proper orientation to engage exposed gear teeth 260 when pulled.

Figure 13:
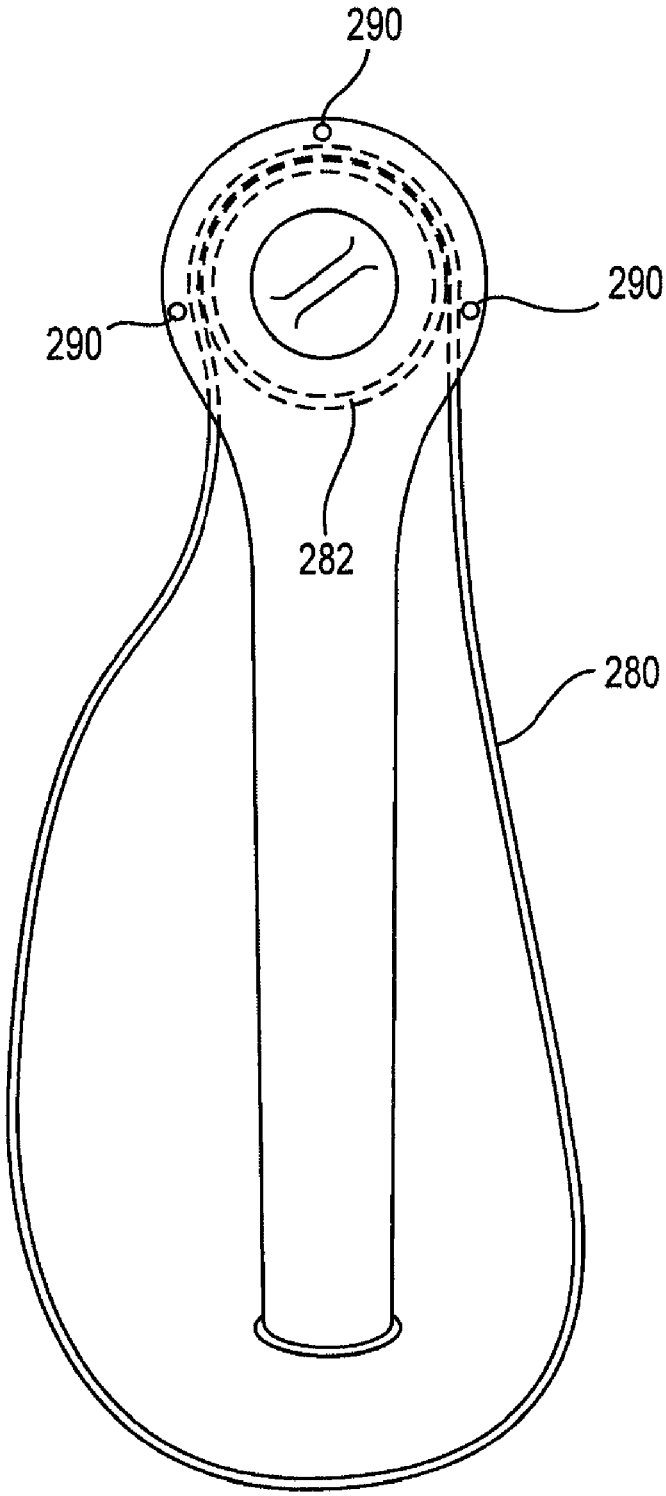
FIG. 13 is a front view of another embodiment wherein the belt is retained by pins in the ratchet head.

A further embodiment is illustrated in FIG. 13. Here the upper end of the ratchet wrench is exposed in a manner similar to that illustrated in FIGS. 11 and 12 above. In this configuration however, sufficient space is provided for a plurality of holding pins 290 to retain belt 280 in an appropriate position. Again, belt 280 again includes teeth on an inner surface thereof (similar to the embodiments outlined above). Further, belt 280 is sized appropriately to allow positioning adjacent an internal gear surface of drive mechanism 282 (as illustrated in dotted line format). It is contemplated that pins 290 are removably positioned within corresponding holes to allow for occasional replacement of belts. It is not likely that belt replacement would be required on a regular basis, therefore the connection or attachment of pins is intended to be relatively secure. For example threaded screws or press fit posts could be used. Naturally, many other securing methodologies would be equally applicable.

In the embodiment illustrated in FIG. 13, the holding bands or positioning bands are no longer present. Naturally, this avoids the possibility of interfering structures during use of the wrench. However, the use of pins 290 does require modification to the wrench, or the design of a specialized wrench structure. As such, this embodiment becomes slightly more involved and specialized, requiring modifications to the wrench body in numerous ways. While three holding pins 290 are illustrated in FIG. 13, any number of pins could be used. It is further noted however, that the pins on the right and left sides of the wrench head are preferably positioned slightly below the halfway line (i.e., the four o'clock and eight o'clock positions roughly). In this manner the belt will be positioned in a desired mating relationship with the drive structure within the wrench while also allowing the necessary freedom to slide or move appropriately.

Figure 14:
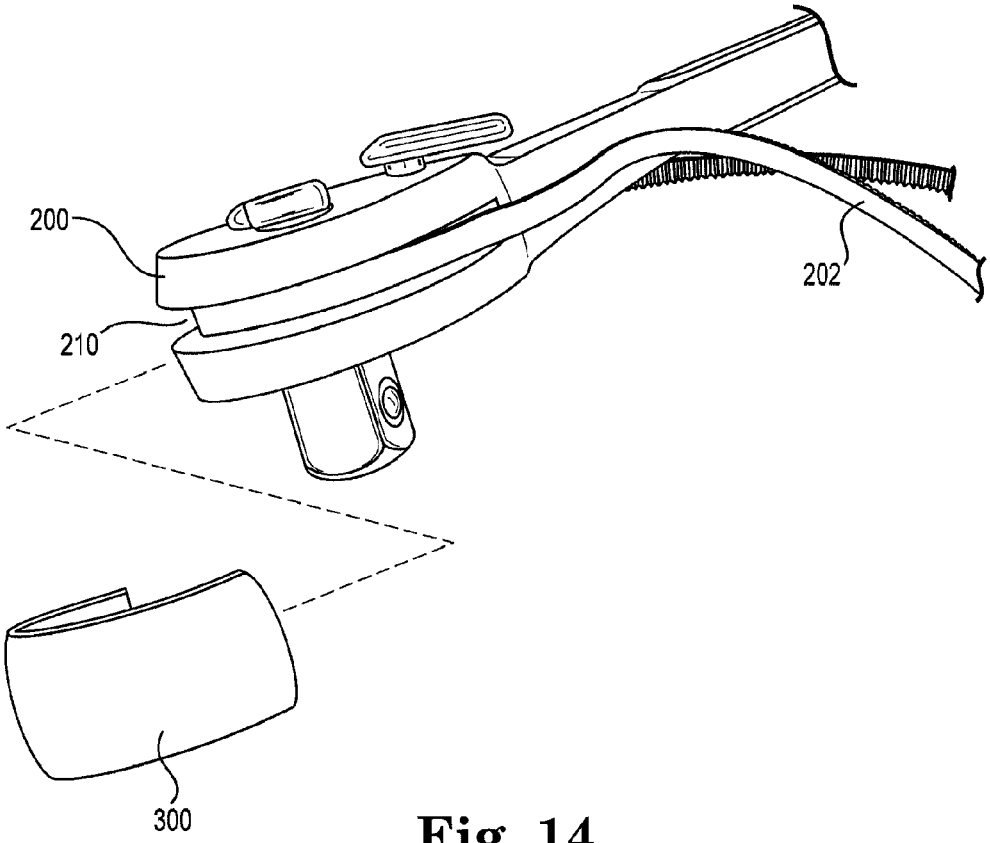
FIG. 14 is a perspective view of a further embodiment using a snap-on cap to contain the belt.

As the embodiment of FIG. 13 illustrates, there are various ways to hold the belt in an operative arrangement with the drive mechanism of the wrench. Using the same concepts as the pin structure illustrate, alternative structures could easily be used to appropriately capture the belt. For example, a snap-fit cap could be attached to the top surface of the wrench and enclose the groove which already exists. FIG. 14 illustrates the use of such a snap-fit cap 300 which is designed to fit over the end of wrench 200. When attached to wrench 200, snap-fit cap 300 will enclose groove 210, thus creating a defined path for belt 202. Once again, the containing and positioning bands are not needed in this embodiment. Snap-fit cap 300 could be made of metal, plastic, composite, or other materials which are rugged and appropriately pliable. It is anticipated that snap-fit cap 300 would be configured to surround more than ½ of the circular wrench head, thus allowing for secure attachment while also containing belt 202 in an appropriate manner. Stated alternatively, the end portions 302, 304 of snap-fit cap 300 would extend to approximately the 4 o'clock and 8 o'clock positions (using a clock face reference). In a similar manner, a smaller insert could be designed to occupy the space immediately adjacent the belt (i.e. fill the groove 210 which is occupied by pins 290 shown in FIG. 13). Such an insert may likely have a T-shaped cross-section so that a portion fills groove 210 while a portion sits adjacent the wrench end.

Although not shown above, those skilled in the art will recognize that yet another embodiment could incorporate a gear structure on an outer surface of the sockets. In this manner, the socket could be attached in a traditional manner, and have the belt appropriately positioned for desired interaction. These sockets could take a form somewhat similar to pulley 60 as illustrated in FIG. 4. Specifically, the socket would be designed to include a groove and underlying gear teeth capable of specifically interacting with the belt. This approach would be effective at providing high speed capabilities using necessary components.

A further embodiment of any present invention is illustrated in FIGS. 15-18. As will be further discussed below, this particular embodiment comprises a high speed attachment system 130, which includes a belt 132, a cover 134 and a cooperating pulley 136. This particular high speed attachment system 130 is configured for use with a typical socket type ratchet wrench (such as wrench 90 illustrated in FIGS. 5 & 6 above) and is intended to be placed over the drive shaft of such a wrench.

Figure 15:
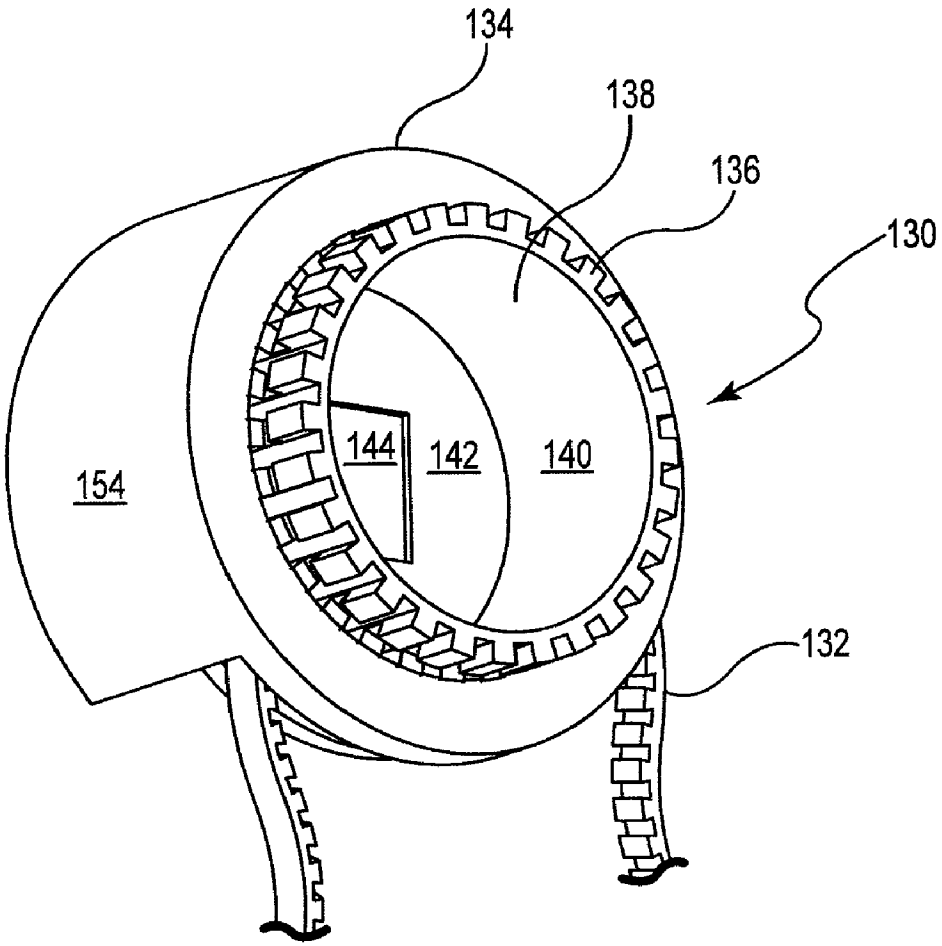
FIG. 15 illustrates a front perspective view of a high speed pulley/cover system for use with a socket-type ratchet wrench.

As generally illustrated in FIG. 15, pulley 136 includes a recessed 138 on one side thereof. The recessed has an inner cylindrical wall 140 and bottom portion 142. Bottom portion 142 specifically includes a square opening 144 which is specifically sized and configured to be placed over the drive shaft of a typical socket type ratchet wrench. When appropriately positioned, the drive shaft of such wrench will extend a defined distance above bottom portion 142. By allowing this drive shaft to extend this distance, a typical socket can still be attached thereto. Recess 138 is specifically designed to accommodate such attachment, thus allowing the socket type ratchet wrench to be utilized for its intended purpose.

Figure 16:
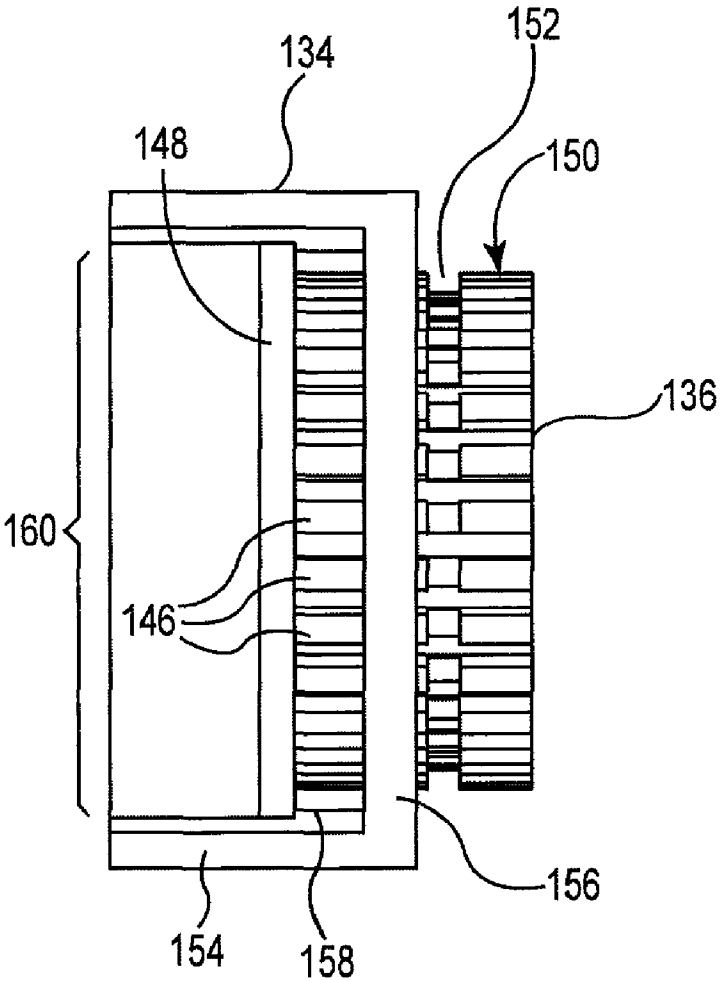
FIGS. 16-18 illustrate a side view, first rear perspective view and second rear perspective view, respectively, of the pulley/cover system of FIG. 15.
Figure 17:
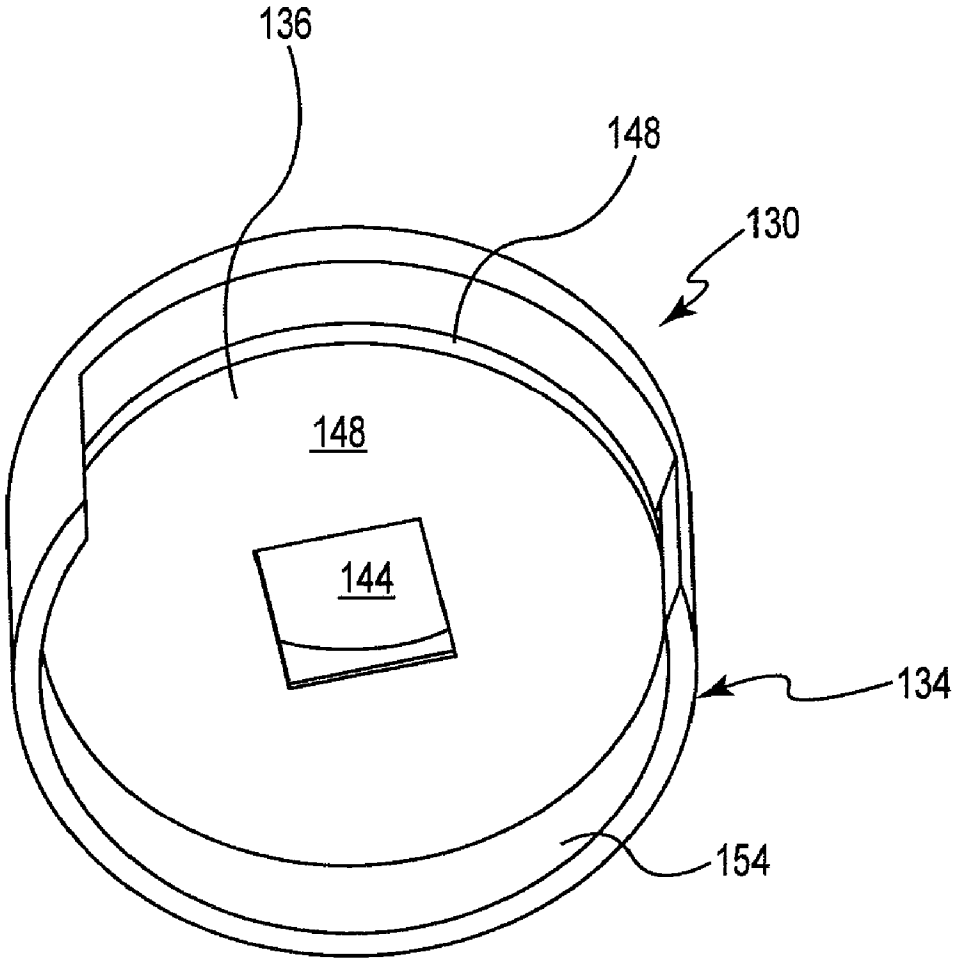
Figure 18:
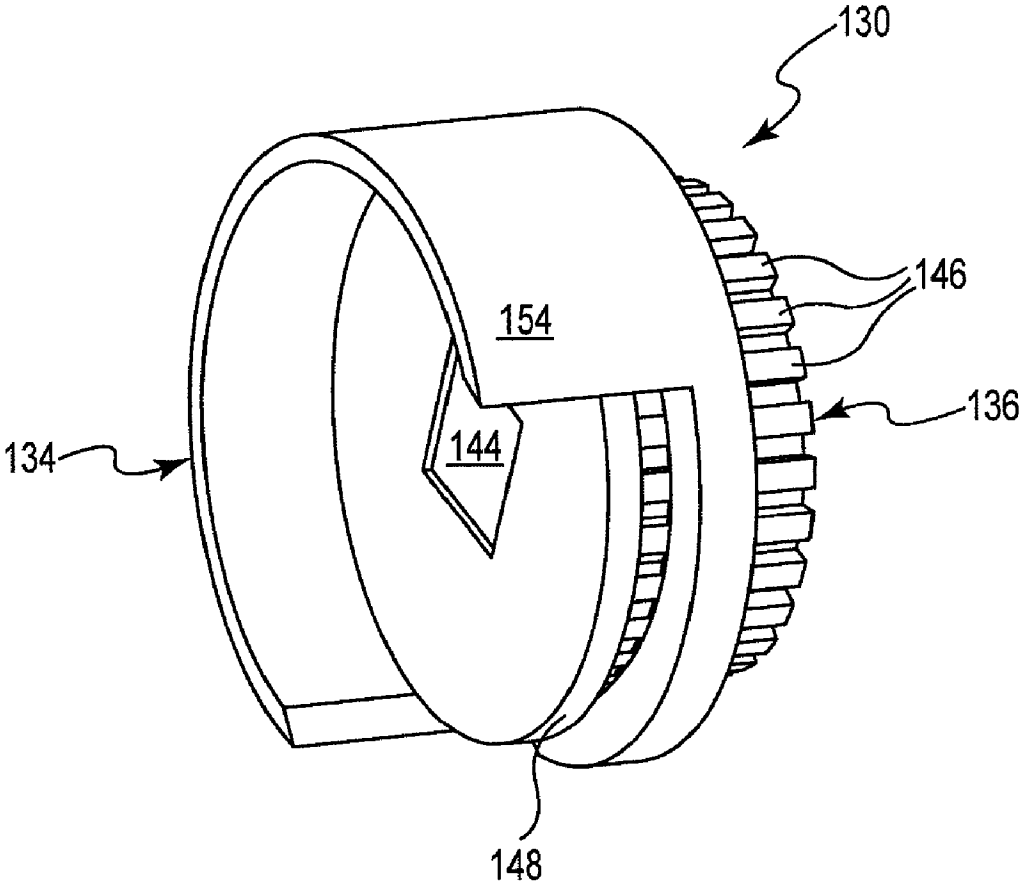

Generally referring to FIGS. 16-18, it is further illustrated how pulley 136 includes a plurality of teeth 146 configured on an outer surface thereof. As will be further discussed below, teeth 146 are specifically configured to mesh or couple with related structures on belt 132. Belt 132 has not been shown in FIG. 16-18 in order to better illustrate the configuration of the other components.

Shown more specifically in FIG. 16 is the relationship between cover 134 and pulley 136. The planar element that makes up bottom portion 142 of recess 138 is formed from a bottom member 148. As can be seen, bottom member 148 is a disc shaped component having an edge that extends beyond the circumferential dimension of pulley 136. In addition, a cylindrical wall member 150 supports teeth 146 on an outer surface, and defines the previously mentioned interior cylindrical wall 140. Cylindrical wall member 150 also has an outer recess 152 formed on an outer portion of cylindrical wall member 150. This recess 152 is specifically configured to receive a snap ring or wire ring (not shown) which will hold the parts together.

Cover 134 is configured to engage and interact with pulley 136 in a defined manner. As will be appreciated, cover 134 is a substantially cylindrical member having a cylindrical outer wall portion 154 and a lateral portion 156. Lateral portion 156 includes a central opening, which is configured to allow pulley 136 to be inserted there through.

As FIG. 16 illustrates in more detail, an inner shoulder member 158 acts as a stop and supports the outer edge of bottom member 148. In this manner, pulley 136 is retained or captured from one direction, within cover 134. Once inserted, the above mentioned snap ring (not shown) can be easily inserted into outer recess 152, thus capturing pulley 136 within cover 134. In this manner, these two components are held in a specific relationship with one another, while also allowing either to freely rotate.

Referring now specifically to FIGS. 17 and 18, better views of the back side or rear side of high speed attachment system 130 are shown. In this particular embodiment, a cylindrical outer wall portion 154 is better illustrated. It is noted that cylindrical outer wall portion 154 is designed to surround bottom member 148 for a predetermined distance. This also provides an opening 160 for a predetermined portion. Although not specifically illustrated, it is contemplated that this open portion will accommodate the handle of a socket type ratchet wrench, when attached. Further, this configuration allows a cylindrical outer wall portion to "cover" a top end of the socket type ratchet wrench. Although the device illustrated in the embodiment of FIG. 15-18 is different from the embodiments discussed above, the concept is some what similar to cover 300 illustrated in FIG. 14. It is contemplated that the size and dimension of the cylindrical outer wall portion can vary and, will potentially depend upon the configuration of the socket type ratchet wrench.

Figure 19:
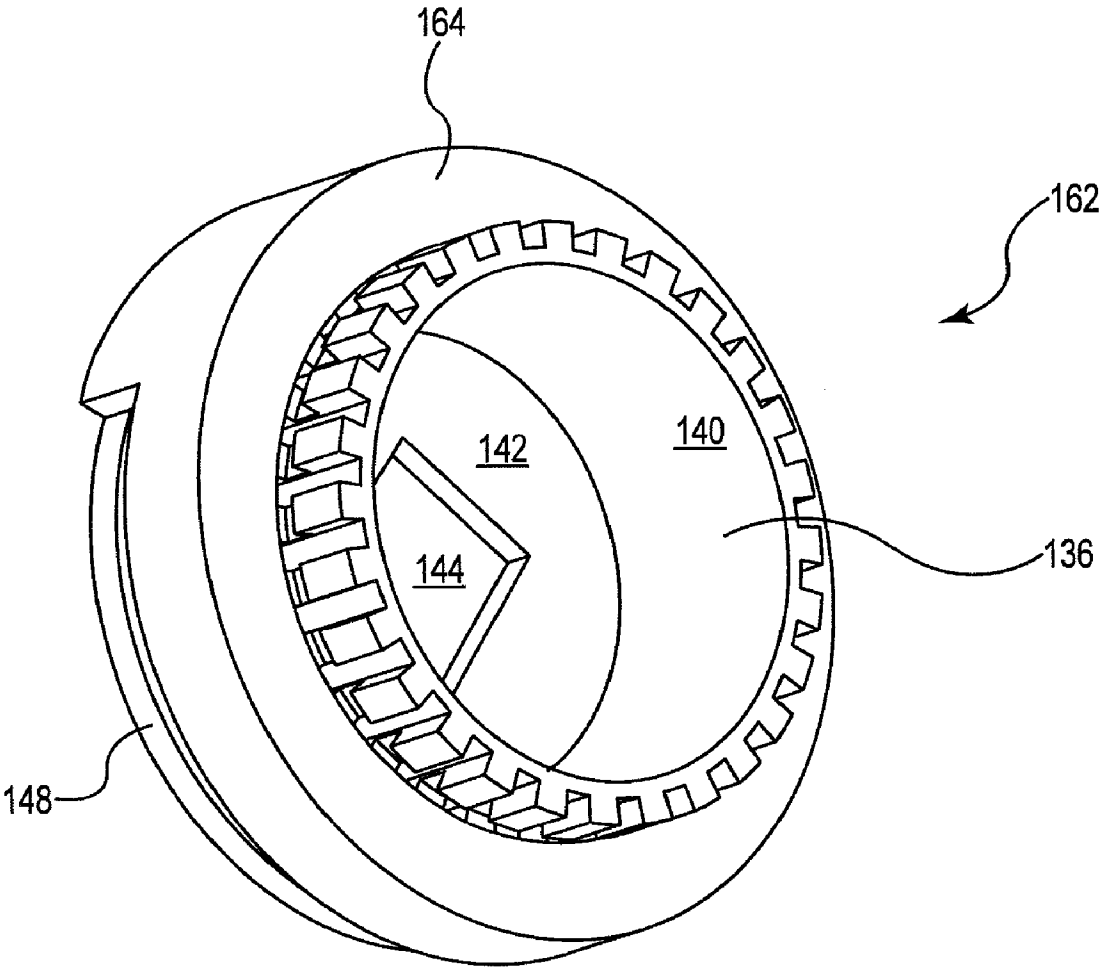
FIG. 19 depicts a front perspective view of an alternative embodiment of a high speed pulley/cover system again for use with a socket-type ratchet wrench.
Figure 20:
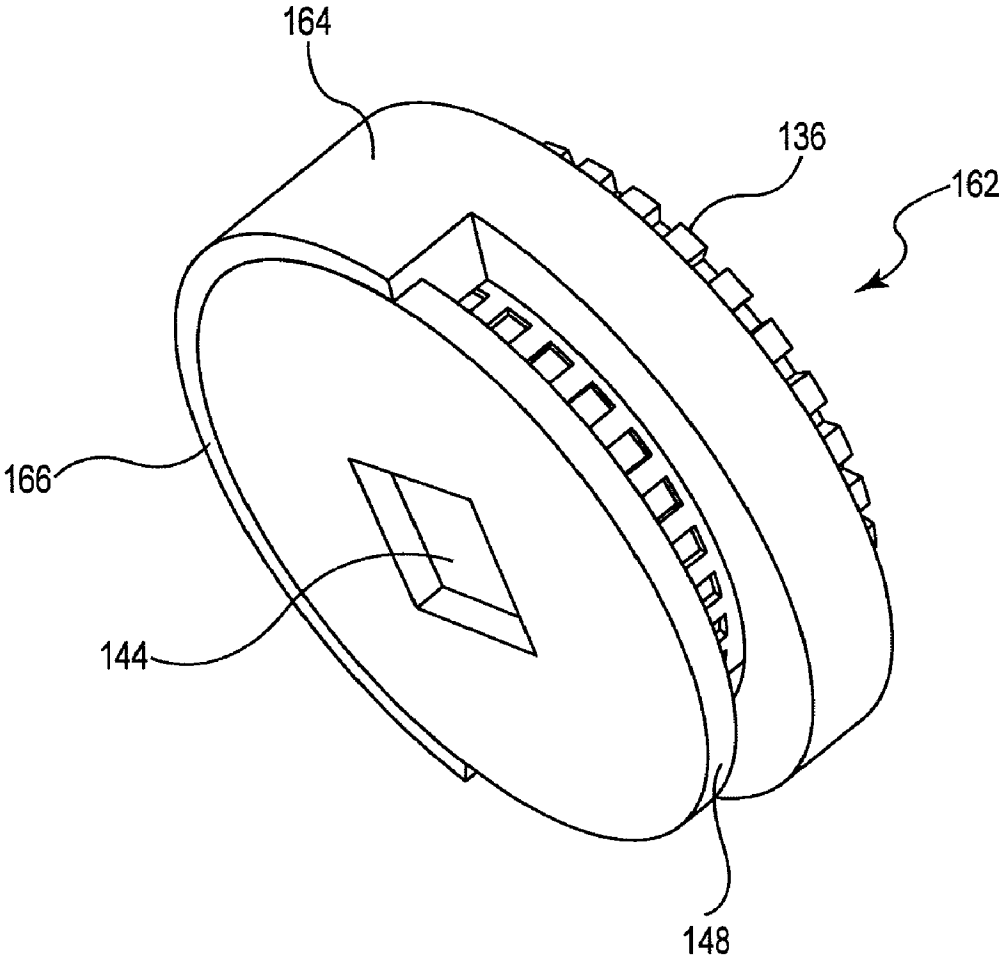
FIGS. 20-21 present a rear perspective and side view, respectively, of the embodiment illustrated in FIG. 19.
Figure 21:
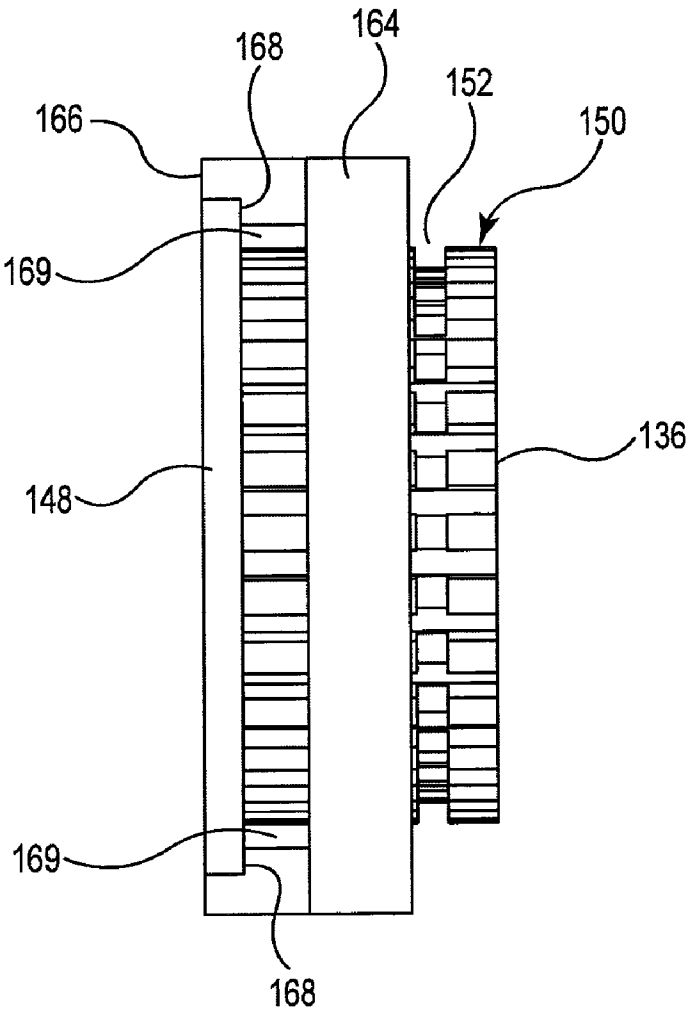

Referring now to FIGS. 19-21, an alternative embodiment of a high speed attachment system 162 is illustrated. In this particular embodiment, pulley 136 is identical to that discussed above. Consequently, a further discussion regarding pulley 136 will not be repeated here. In alternative high speed attachment system 162 however, a revised cover 164 has been utilized. As best shown in FIGS. 20 and 21, the overall length of cover 164 has been substantially shortened. When assembled, a back edge 166 is positioned in substantially the same plane as the back surface of bottom member 148. Consequently, a low profile device is achieved which is easily utilized by virtually all socket type ratchet wrenches.

As illustrated in the side view of FIG. 21, short cover 164 has a similar recess or ledge 168 which is positioned against bottom member 148. A gap 169 exists for the insertion of a belt (not shown in these particular figures). It will be appreciated that the belt will be incorporated and utilized in substantially the same manner as discussed above in relation to the embodiments of FIGS. 15-18.

An additional embodiment for a high speed attachment system 170 is illustrated in FIGS. 22 through 25. In this particular embodiment, high speed attachment system 170 is very similar to the attachment system illustrated in FIGS. 15-20, however, the cover 172 has again been slightly modified. In this particular embodiment, pulley 136 is identical to that shown in FIGS. 15-18, and thus like reference numbers are utilized in FIGS. 22-25 to reference like parts.

Figure 22:
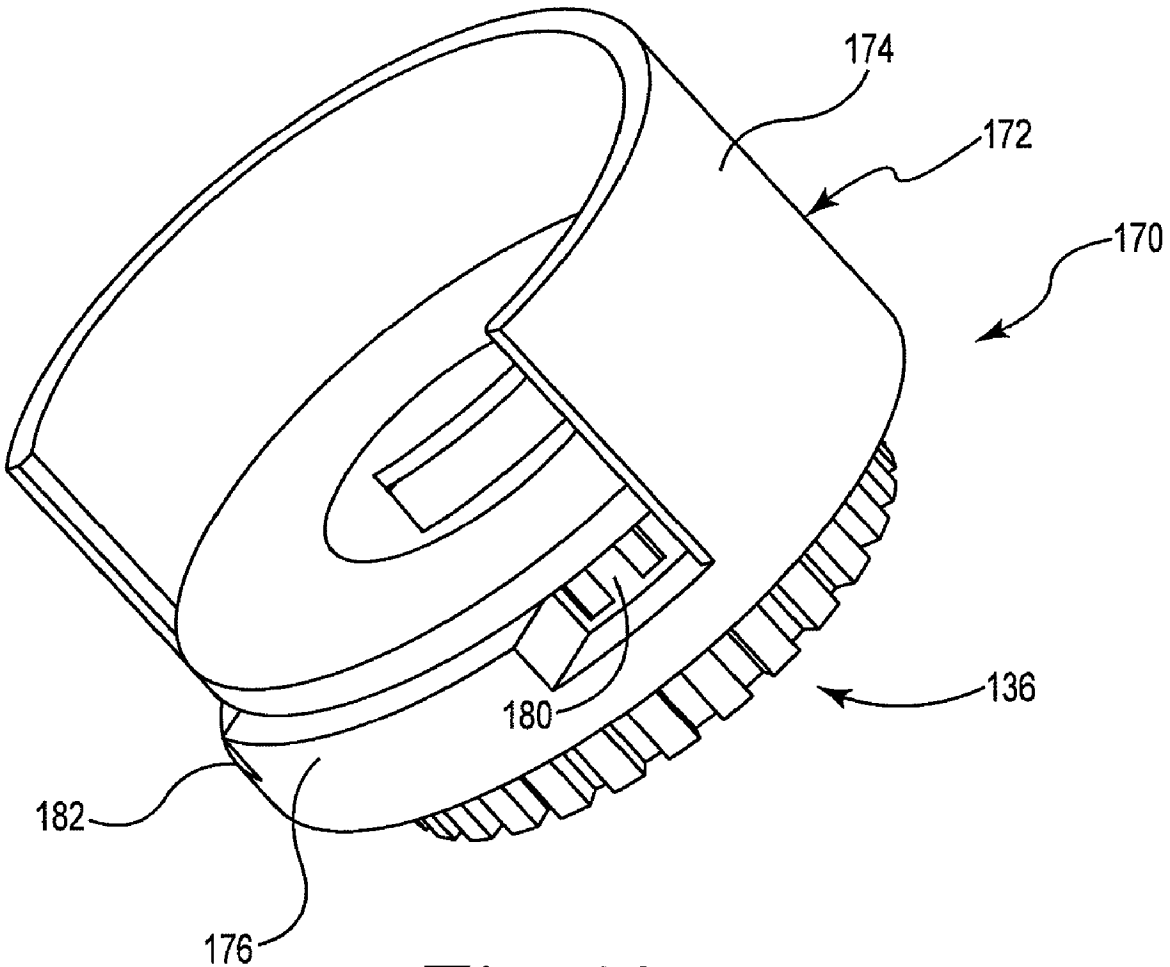
FIG. 22 shows a rear perspective view of a second embodiment of the high speed pulley/cover system.
Figure 23:
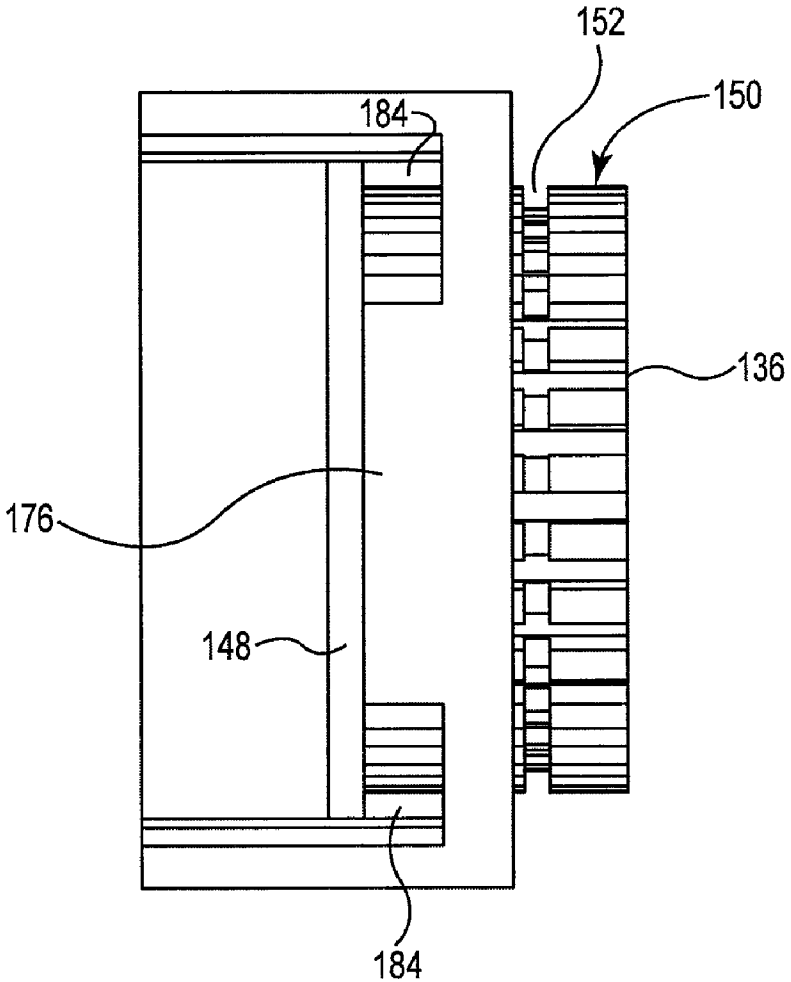
FIGS. 23-25 show side, front and front perspective views of the pulley/cover system illustrated in FIG. 19.
Figure 24:
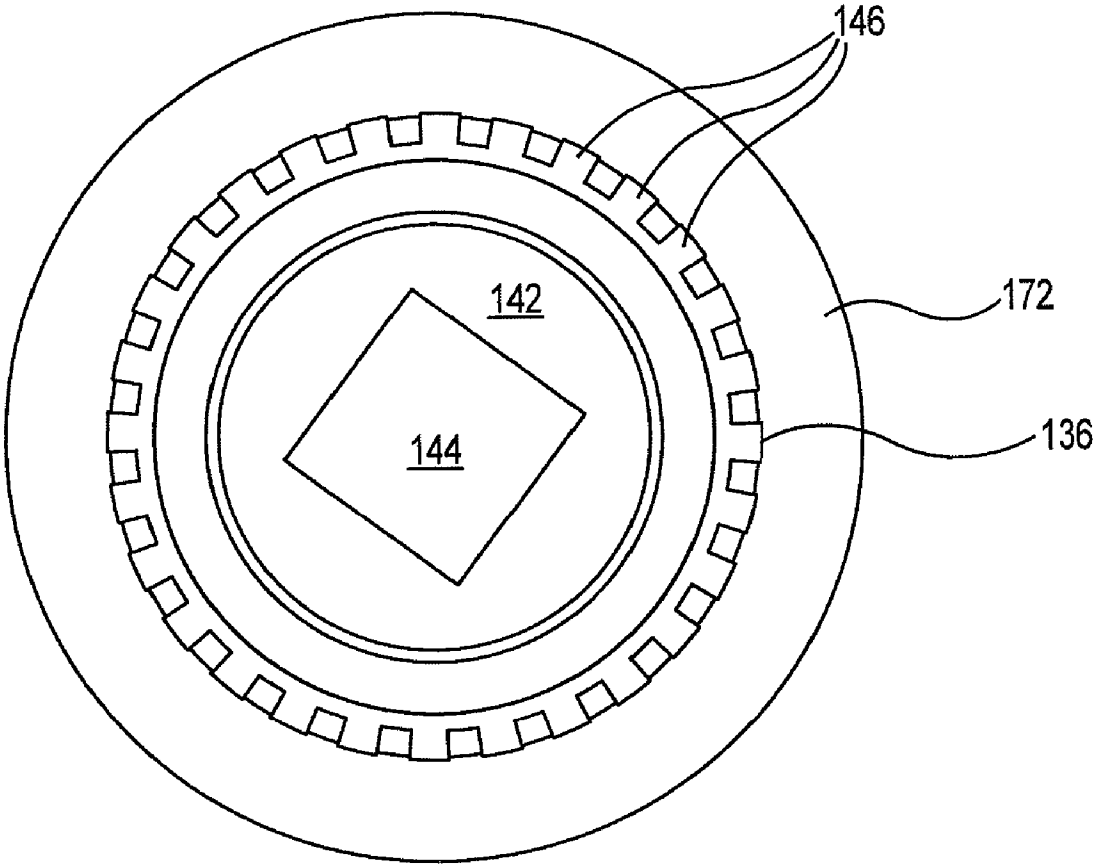
Figure 25:
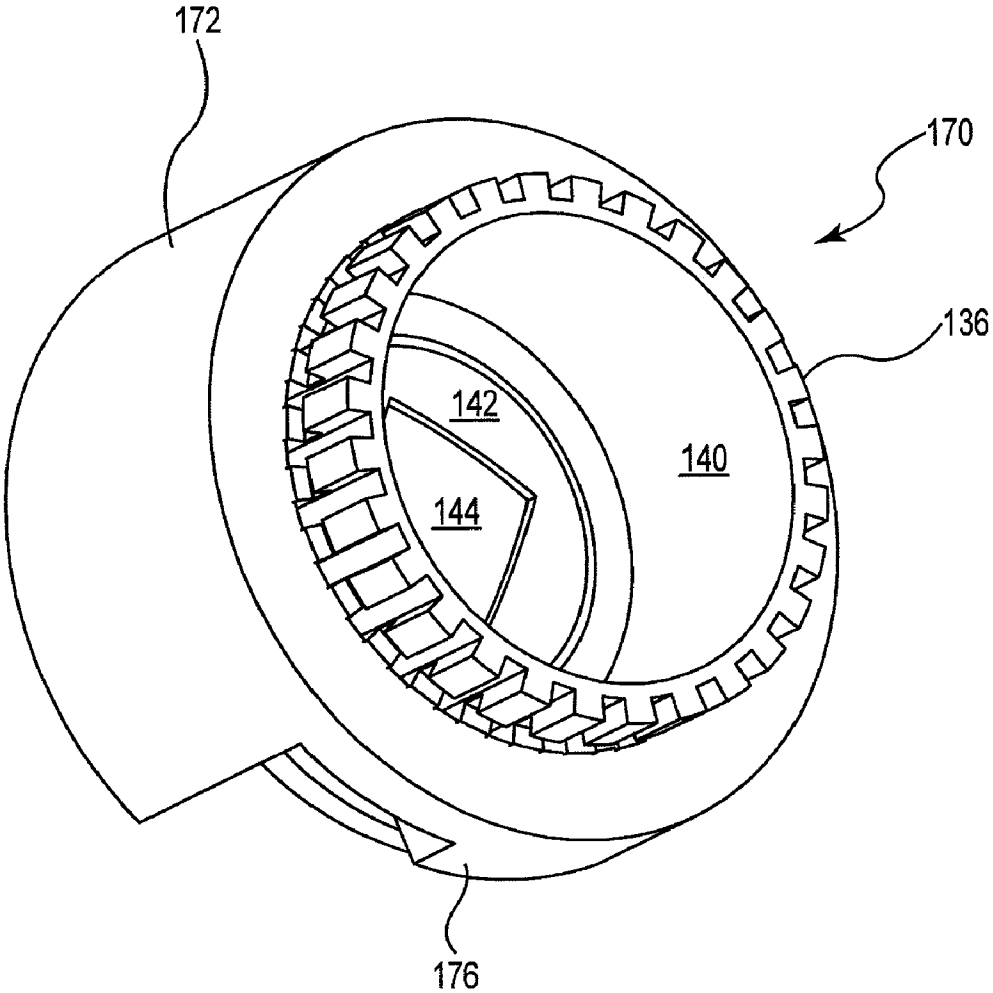

Referring now to FIG. 22, cover 172 is illustrated from a perspective view. Again, a cylindrical outer wall portion 174 is utilized to help contain pulley 136, and to create a covering portion when attached to a socket type ratchet wrench. In addition, an extension lip 176 exists in another portion of cover 172. This extension lip is again partially cylindrical in nature, and acts to cover a portion of pulley 136. The combination of extension lip 176 and cylindrical outer wall 174 creates a first gap 180 and second gap 182, which allows the belt 132 to interact with pulley 136 while also extending to be accessible. A side view of this configuration is better illustrated in FIG. 23 and more clearly shows extension lip 176, first gap 180 and second gap 182. In this particular embodiment, a space or chamber exists between pulley 136 and cover 172 which is immediately adjacent to certain teeth members. In use, this space or gap is filled by belt 132 thus allowing interaction with teeth 146. In addition, the belt will pass through first gap 180 and second gap 182, thus creating a contained space within which the belt may travel. As better illustrated in FIG. 23, the upper edge of extension lip 176 also provides a support for bottom member 148 of pulley 136. Again, this structure will help to contain pulley 136 and cover 172 in a fixed relationship with one another, while also allowing rotation.

Figure 26:
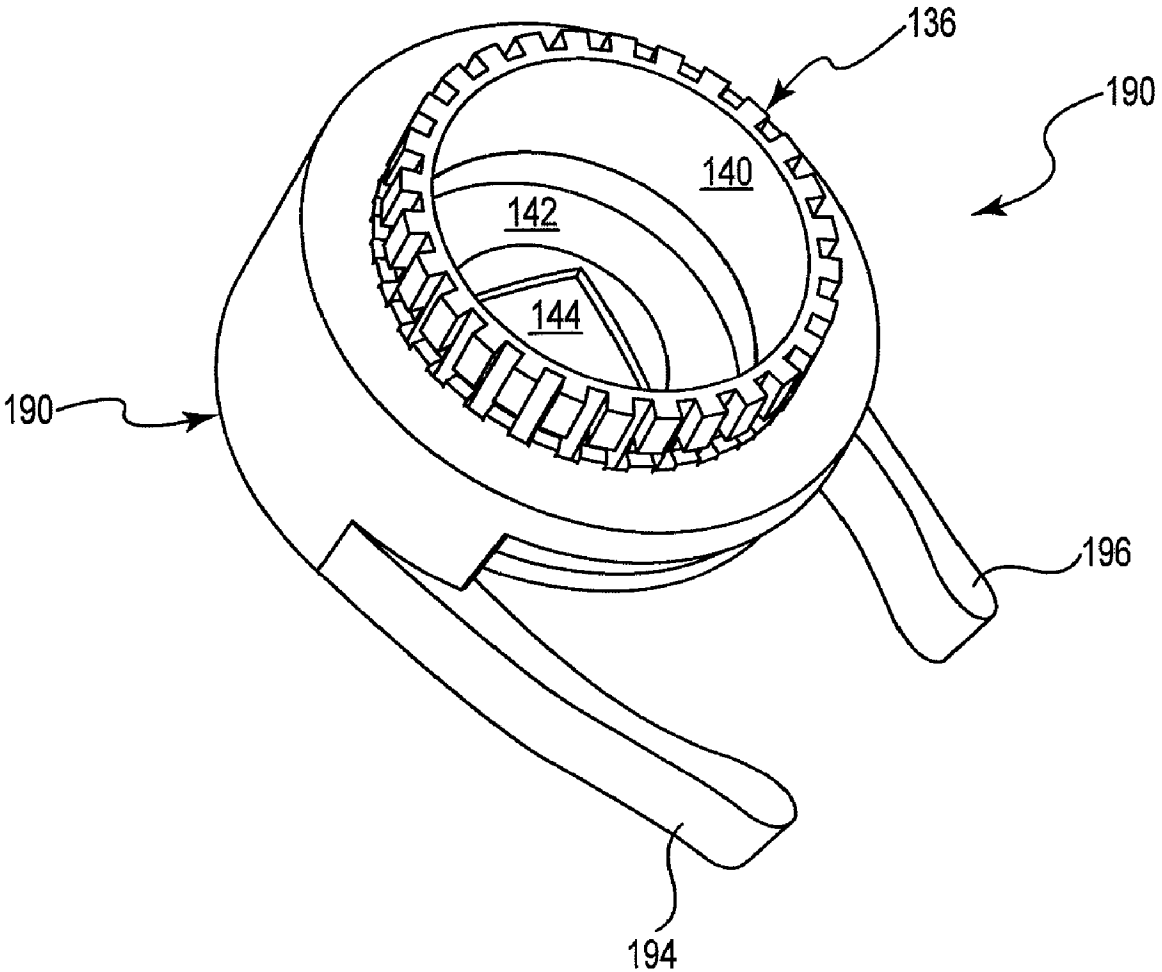
FIG. 26 illustrates a front perspective view of a third embodiment of a pulley/cover system.
Figure 27:
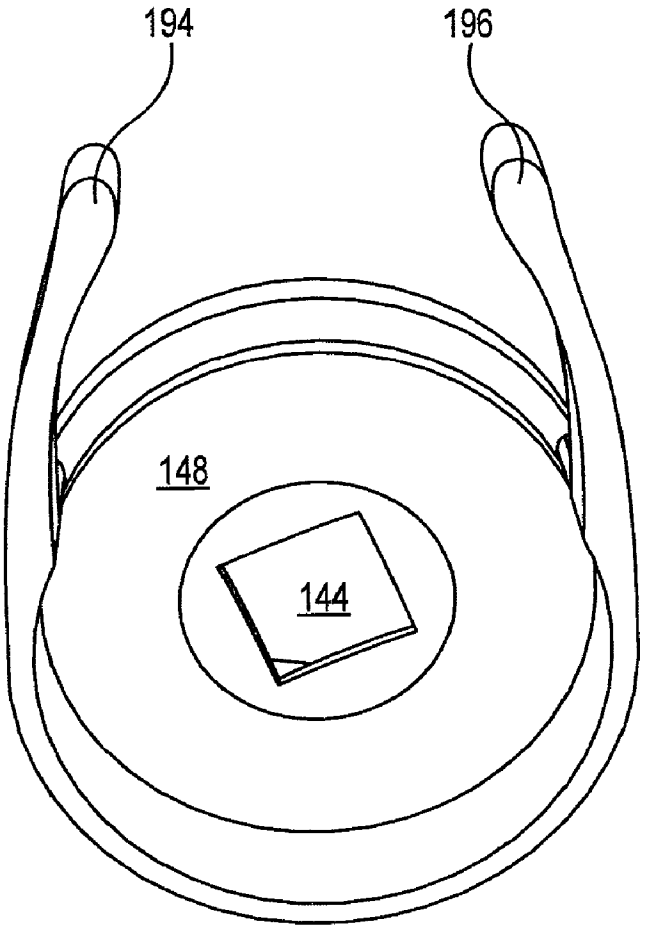
FIGS. 27-28 show a rear perspective and side view, respectively, of the pulley/cover system of FIG. 23.
Figure 28:
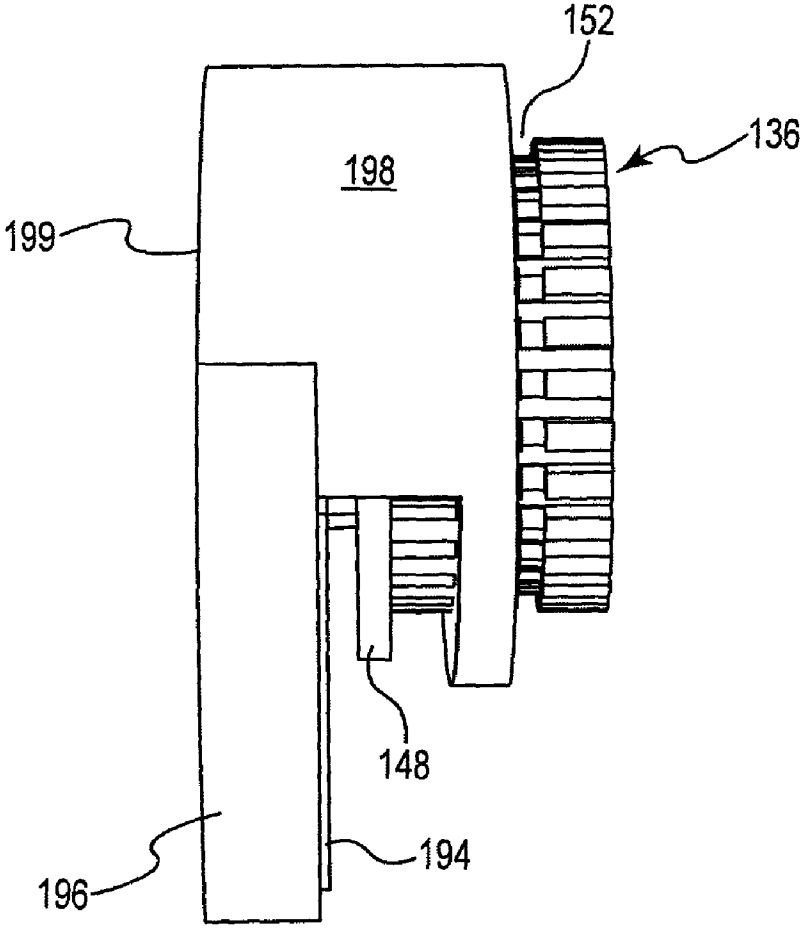

Shown in FIGS. 26-28 is another high speed attachment system 190, which is yet another embodiment of the present invention. In this particular embodiment, high speed attachment system 190 again utilizes pulley 136 to achieve a high speed drive structure for use with a socket type ratchet wrench. In this particular embodiment, a revised cover 192 is configured to have a first leg extension 194 and a second leg extension 196 extending from a cylindrical cover body 198.

As best illustrated in FIG. 27, of both first extension 194 and second extension 196 create lateral support structures which are intended to be coupled with socket type ratchet wrench in use. Beyond first extension 194 and second extension 196, cover 192 is configured very similar to cover 134 illustrated above in FIGS. 15-18. And again, pulley 136 is identical to the one used in the various embodiments previously discussed. As anticipated, first extension 194 and second extension 196 will help hold cover 192 in a semi fixed orientation in relation to an attached socket type ratchet wrench. In certain instances, this will be helpful to avoid any undesired movement of cover 192 while pulley 136 is being rotated.

A side view of this particular embodiment is shown in FIG. 28, which shows the axial orientation of various components. More specifically, the alignment of first extension 194 and second extension 196 with an outer edge 199 of cylindrical cover body 198 is shown. Again, pulley 136 includes recess 152 designed to receive a snap ring (not shown) which will hold pulley 136 in a desired position within cover 192, while also allowing rotation of the components in relation to one another.

Figure 29:
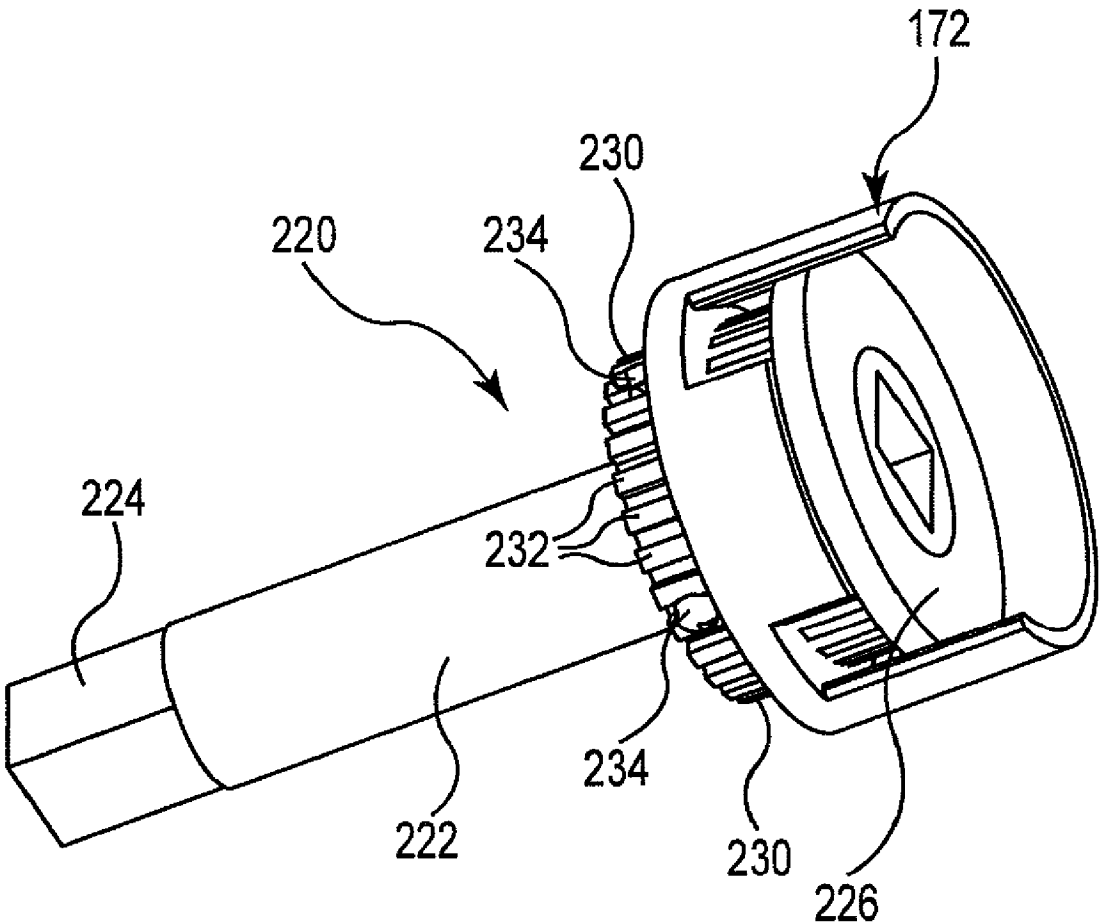
FIG. 29 provides a rear perspective view of a pulley/cover extension system of the present invention.
Figure 30:
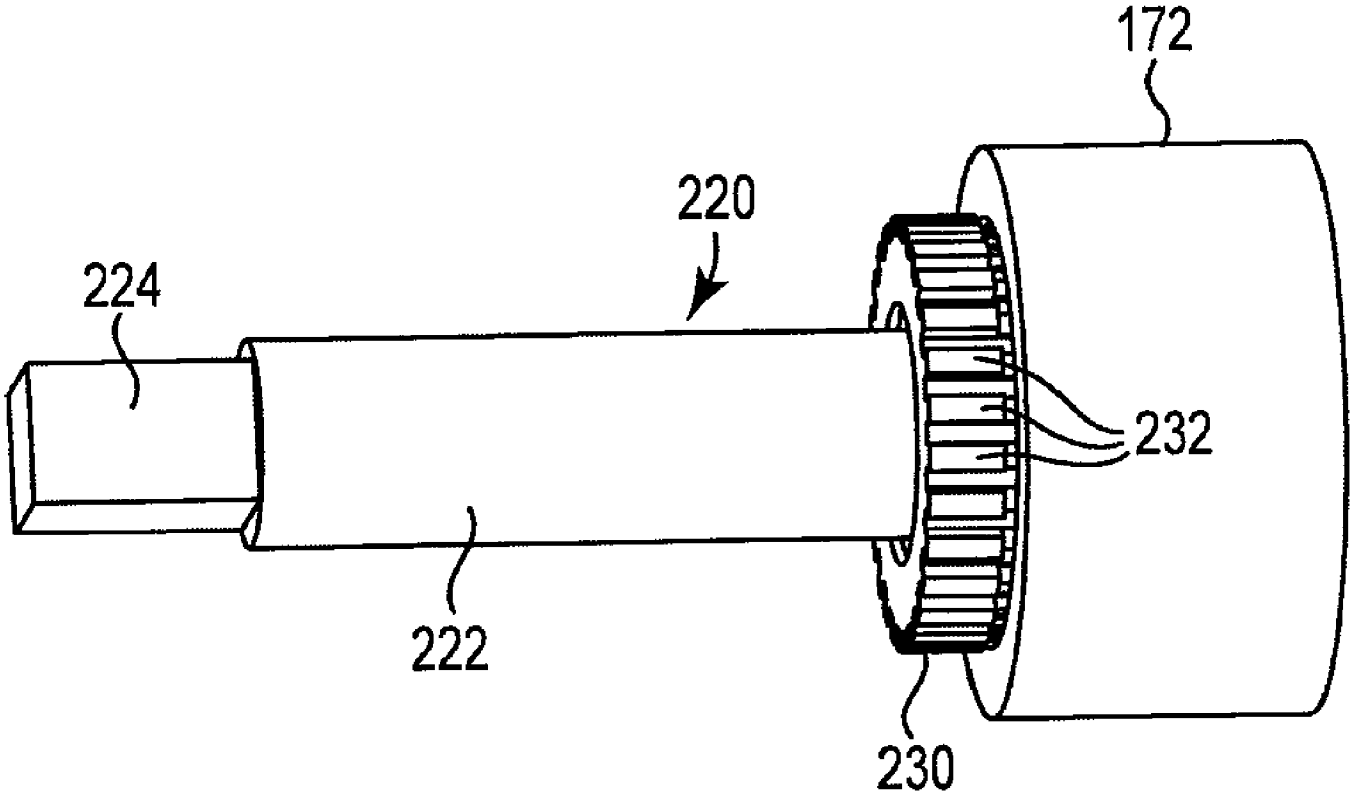
FIGS. 30-31 show side and front perspective views, respectively, of the pulley/cover extension system illustrated in FIG. 26.
Figure 31:
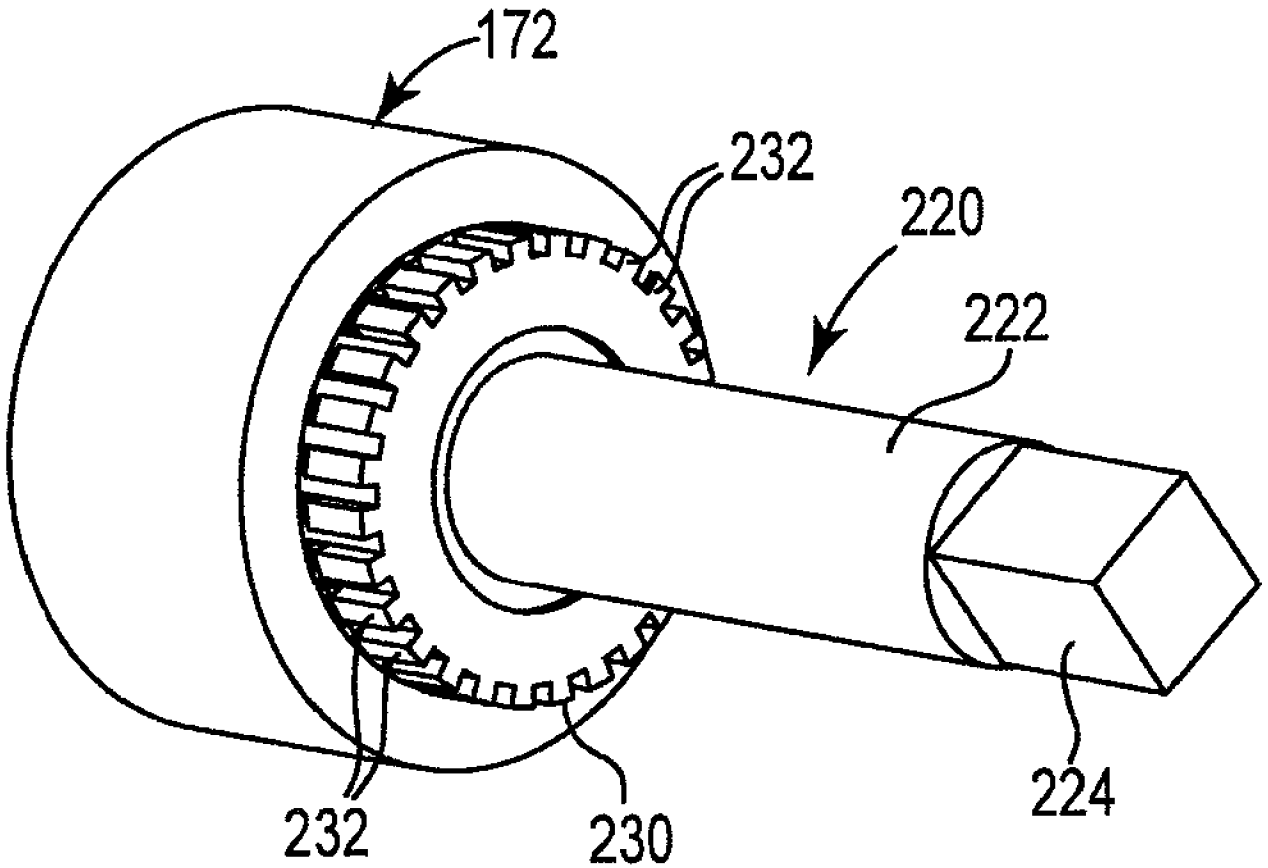

Referring now to FIGS. 29-31, yet an additional embodiment of the present invention is illustrated. In this particular embodiment, a high speed attachment extension is provided which is again configured to be used with a socket type ratchet wrench. In this particular embodiment, cover 172 (discussed above in relation to FIGS. 22-25) is utilized. For consistency, like numerals have been utilized to identify like parts in the various embodiments. In this particular embodiment however, a pulley extension 220 is utilized. Pulley extension 220 has many characteristics similar to pulley 136 discussed above, however an extension shaft 222 has been provided on one end thereof. More specifically, extension shaft 222 extends in an axial direction, and has a square drive connection 224 at an end thereof. Square drive connection 224 is configured and designed to receive a typical socket, and thus operate similar to the well known socket type ratchet wrench. At an opposite end of pulley extension 220 an end member 226 is configured as a disc, and includes a square or cube shaped opening 228. In a manner similar to the embodiments discussed above, square cube shaped opening 228 is designed for attachment to a typical socket type ratchet wrench (not shown).

As shown more specifically in FIG. 29, an outer surface 230 of pulley extension 220 is again configured to have a plurality of teeth 232 thereon. Teeth 232 are configured to extend from outer surface 230 at locations within cover 172 and extending outwardly from cover 172 on a side towards shaft 222. In FIG. 29, the portion shown outside of cover 172 include a plurality of openings 234 configured to receive set screws (not shown). In this particular embodiment, the portion of pulley extension 220 including outer surface 230 and member 226 can be designed separate from shaft portion 222. In operation, these two members can be attached to one another using a plurality of set screws (again, not shown) which are designed to be inserted into openings 234. Alternatively, pulley extension 220 could be configured as a single piece, as shown in FIGS. 30 and 31.

Similar to the embodiment illustrated above in FIGS. 22-25, the high speed connector assembly of FIGS. 29-31 accommodates the use of a belt (not shown) which is operably coupled to teeth 232 the outer cylindrical surface 230 of pulley extension 220. Once attached to a socket type ratchet wrench, this device provides a high speed tool consistent with the concepts described above.

As generally outlined above, the present invention utilizes a belt coupled to the drive mechanism of a ratchet style wrench to achieve high speed operation. The coupling or cooperation between the belt and the drive mechanism is generally achieved by the cooperative action of gears and a drive belt, held in a generally meshed or interfering relationship with one another. The meshed relationship is largely established when force is applied to the belt (i.e. the belt is pulled). The materials used to make up the belt, and the configuration of components enhance this operation. That said, it is only required to have the teeth loosely or generally mesh with the drive, and it is only required to have the belt loosely adjacent the drive teeth when not being used.

The variations discussed above highlight the fact that different approaches can be used to maintain the belt in a cooperational position with the drive of the wrench, thus allowing for high speed operation. Further, the various embodiments outline various ways for the belt drive concept to be incorporated into wrenches of different types. Generally speaking, each of these embodiments cause the belt to be maintained in an appropriate alignment/position for the contemplated high speed operation of the wrench. Some approaches have distinct advantages, such as simplicity or ease of use. Others may avoid potentially interfering structures that could be a nuisance to the user. By first incorporating the appropriate structures to maintain the proper alignment/position, the wrench can then be operated at high speeds by simply pulling on the belt.

Although not specifically shown, it is contemplated that another possible alternative is the use of the above concepts without the need for a socket type wrench. For example, the device shown in FIGS. 29-31 could easily be adapted for handheld use without a coupled wrench. In the adaptation, a user could attach a socket to shaft 222 and simply apply force via the belt alone. More specifically, a user could hold cover 172 in their hand, and simply pull on an attached belt to cause rotation of shaft 222. In this adaptation, it may be more convenient to modify cover 172 to accommodate better holding. Further, a ratcheting structure could also be added, thus avoiding the need for a separate wrench. Additionally, the various pulley devices discussed above could be adapted to fit onto a screwdriver (e.g. coupled to the shaft of a screwdriver) to allow high speed operation. It is contemplated that the cover would be configured with a holding portion for a user to grip while pulling the belt. Such a configuration would cause the screwdriver to spin or rotate at a high rate of speed. This screwdriver variation could be used with or without a ratcheting mechanism.

As generally described above, the belt drive concept allows well understood wrenches to be adapted in a manner to provide high speed operation. This functionality is provided in a manner which is straight forward and easily achieved. Although several embodiments and implementations have been described above, the belt drive concept can likely be modified in various ways without departing from the general spirit of the following claims.

The invention claimed is:

1. A high speed device for attachment to a ratchet type socket wrench to accommodate high speed operation of the wrench, comprising:

a high speed drive pulley adapted to be removably attached to a drive portion of the socket wrench and to receive an alternate drive source, the high speed drive pulley having a cylindrical outer wall with a drive force receiving structure on an outer surface of the cylindrical outer wall, the pulley further having a connecting portion coupled to the outer wall and situated in a plane substantially perpendicular to the axis of the cylindrical outer wall, the connecting portion having a coupling structure capable of being selectively attached to the drive portion of the ratchet type socket wrench;

a cover rotatably attached to the pulley and surrounding a portion of the drive force receiving structure, the cover configured to create a predetermined space between the cylindrical outer wall and an inner surface of the cover; and a drive belt positioned within the predetermined space, the drive belt having a force transfer structure engaged with the drive force receiving structure, whereby pulling on the belt will cause rotation of the high speed drive pulley.

2. The high speed device of claim 1 wherein the drive force receiving structure comprises a plurality of gear teeth and the force transfer structure comprises a plurality of corresponding teeth, wherein the belt and pulley are coupled with one another by the engagement of the teeth.

3. The high speed device of claim 1 wherein the connecting portion comprises a substantially planar member having an opening therein sized to closely receive the drive portion of the ratchet type socket wrench.

4. The high speed device of claim 3 wherein the opening is a substantially square opening attachable to a square drive portion of the socket type ratchet wrench.

5. The high speed device of claim 3 wherein the planar member of the connecting portion extends only a predetermined distance along the drive portion thereby allowing the socket to be attached directly to the drive shaft of the wrench.

6. The high speed device of claim 3 wherein the planar member of the connecting portion extends only a predetermined distance which thus allow the connection of an extender and a socket coupled to the extender.

7. The high speed device of claim 1 wherein the cover further having an extension portion further covering a handle portion of the wrench.

8. The high speed device of claim 7 wherein the extension portion is further configured to interfere with the handle portion when the pulley is rotated.

9. The high speed device of claim 1 further comprising a snap ring coupled to the pulley and having an extension for interfering with the cover member, thereby capturing the pulley and cover in a rotatable relationship with one another.

10. The high speed device of claim 9 wherein the belt is captured within a chamber by the cover to be in a position to allow for engagement of the force transfer structure of the belt with the force receiving structure of the pulley.

11. The high speed device of claim 1 wherein the high speed drive pulley further comprises an extension shaft capable of selective attachment to a socket.

12. An attachment system for use with a ratchet type socket wrench, comprising:

a pulley having a disk portion and an outer edge portion, wherein the disc portion defines an attachment opening attachable to a drive shaft of the ratchet type socket wrench and wherein the outer edge portion has a substantially cylindrical force receiving surface and the disk portion creates a radial wall positioned on one side of the force receiving surface; and a cover coupled to the pulley in a manner to allow rotation of the cover and pulley in relation to one another about an axis which is aligned with an axis of the substantially cylindrical force receiving surface; the cover further having a substantially cylindrical outer wall portion positioned above force receiving surface and adjacent to the radial wall to define a chamber extending a predetermined circumferential distance around the pulley.

13. The attachment system of claim 12 wherein the chamber is sized to receive a belt.

14. The attachment system of claim 12 wherein the attachment opening is a square opening configured to surround a square drive portion of the ratchet type socket wrench.

15. The attachment system of claim 12 wherein the force receiving surface comprises a plurality of teeth configured to engage a plurality of similar teeth structures on the surface of a belt.

16. The attachment system of claim 12 wherein the disk portion has a rear surface, and wherein the cover has a partially cylindrical extension portion extending beyond the rear surface.

17. The attachment system of claim 16 wherein the disc portion has a front surface substantially parallel with the rear surface, and the cover has a circumferential ledge portion extending around an interior of the cylindrical outer wall, the circumferential ledge supporting and capturing an outer edge of the disk portion to cause axial alignment of the cover and the pulley.

18. The attachment system of claim 17 wherein the cover has an inwardly extending wall having an inner edge sized to be adjacent the substantially cylindrical force receiving surface of the pulley, wherein the inwardly extending wall further defines the chamber.

19. The attachments system of claim 18 wherein the force receiving outer surface extends beyond the inwardly extending wall on a side opposing the circumferential ledge, and wherein the pulley further has a recess configured to receive a snap ring.

20. A high speed drive mechanism for driving a socket at a high rate of speed to thereby quickly and efficiently remove a fastener, the high speed drive mechanism comprising:

a pulley having a cylindrical outer surface with a force receiving structure thereon, the pulley being removably coupled to the socket;

a cover rotatably coupled to the pulley, the cover having a covering portion enclosing at least a portion of the cylindrical outer surface, the cover and the pulley thereby creating an enclosed chamber wherein the force receiving surface forms one wall of said chamber and wherein a surface of the cover creates another wall of said chamber; and a belt having a force transfer structure thereon, wherein a portion of the belt passes through the chamber and is positioned such that the force receiving structure and the force transfer structure cooperate with one another, wherein a force applied to the belt by pulling is thereby transferred to the socket due to the coupling of the pulley to the socket.

21. The high speed drive mechanism of claim 20, wherein the pulley further comprises an extension having an attachment end for attachment to the socket.

22. The high speed drive mechanism of claim 20 wherein the pulley is coupled to the socket via a drive shaft of a socket type ratchet wrench, wherein the pulley has a central surface with an opening therein for receiving the drive shaft.

23. The high speed drive of claim 20 wherein the cover has a handle portion for holding the cover in a user's hand while the user pulls on the belt with the other hand.

24. The high speed drive of claim 21 further comprising a ratchet mechanism for providing the ratcheting rotation of the pulley relative to the cover, wherein the ratchet mechanism allows rotation in a first direction while preventing rotation in a second direction.

* * * * *